US007600519B2

(12) United States Patent
Dinh

(10) Patent No.: US 7,600,519 B2
(45) Date of Patent: Oct. 13, 2009

(54) EYELASH EXTENSIONS AND METHOD FOR APPLYING EYELASH EXTENSIONS

(76) Inventor: Daniel Phu Dinh, 14201 Boony La., Garden Grove, CA (US) 92843

( * ) Notice: Subject to any disclaimer, the term of this patent is extended or adjusted under 35 U.S.C. 154(b) by 596 days.

(21) Appl. No.: 11/473,943

(22) Filed: Jun. 23, 2006

(65) Prior Publication Data

US 2007/0295352 A1 Dec. 27, 2007

(51) Int. Cl.
*A41G 3/00* (2006.01)

(52) U.S. Cl. ..... 132/201; 132/216

(58) Field of Classification Search ..... 132/201, 132/216, 217, 53

See application file for complete search history.

(56) References Cited

U.S. PATENT DOCUMENTS

2007/0023062 A1 * 2/2007 McKinstry et al. ..... 132/201

* cited by examiner

*Primary Examiner*—Robyn Doan
*Assistant Examiner*—Rachel R Steitz
(74) *Attorney, Agent, or Firm*—Tope-McKay & Associates; Marcus Risso

(57) ABSTRACT

Eyelash extensions and a method for applying the same are described. The eyelash extensions comprise a first filament having both a proximal end and a distal portion with a distal end. The method for applying the eyelash extensions comprises acts of fastening the user's eyelashes against the user's face and attaching multiple layers of eyelash extensions (the proximal end) to the user's eyelashes. Each of the multiple layers is applied one layer at a time, thereby providing a user with eyelashes having eyelash extensions attached thereto.

17 Claims, 28 Drawing Sheets

100
110
102
112
114
104
106
108

114
104
108

104

118
108
102
104
120
116

108
122
106
124
122
104

106
122
126
128
122
130
132
104
108

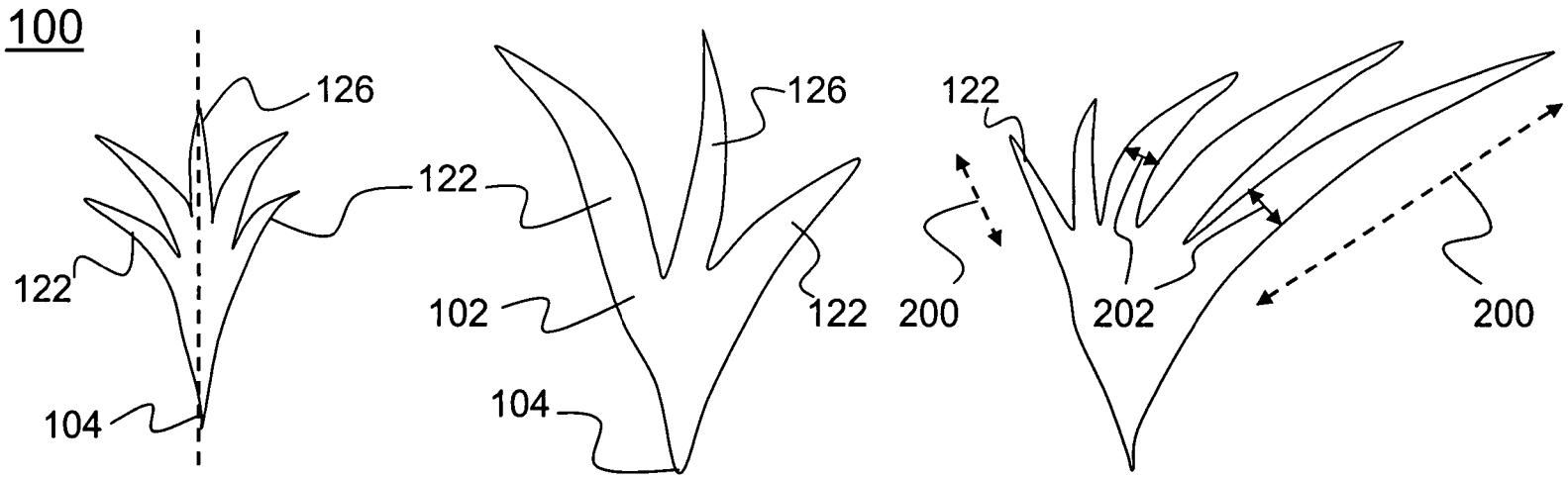
FIG. 2A
FIG. 2B
FIG. 2C
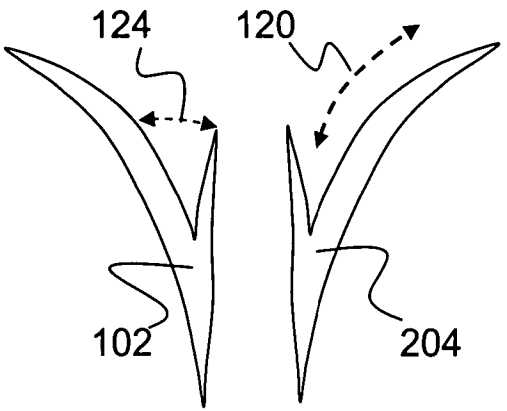
FIG. 2D
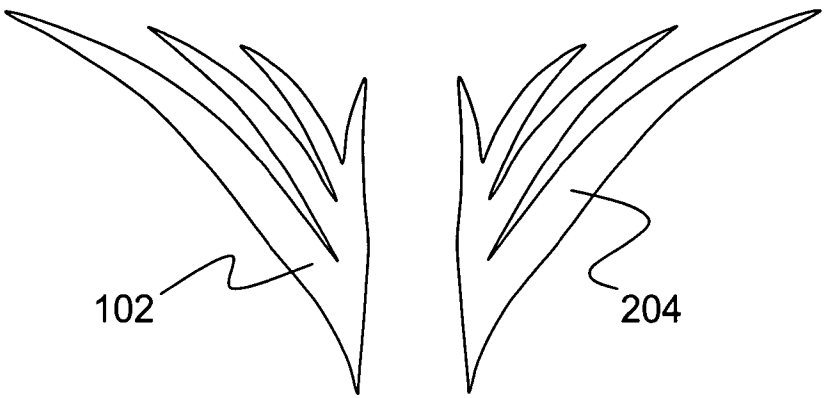
FIG. 2E

EYELASH EXTENSIONS AND METHOD FOR APPLYING EYELASH EXTENSIONS

BACKGROUND OF THE INVENTION (1) Field of Invention

The present invention relates to false eyelashes, and more particularly to a method for applying eyelash extensions to a user's eyelashes.

(2) Description of Related Art

Beauty products have long been known in the art. Users, women in particular, have sought a variety of beauty products to enhance their aesthetic appearance. For example, blush is often used to add color to a woman's cheeks. As another example, lipstick is traditionally used to add a variety of colors and features to a user's lips. To enhance the appearance of a user's eyelashes, the user often applies mascara. Mascara is applied to the user's eyelashes to both thicken and bring color to the eyelashes.

As an alternative to mascara, a user can apply adhesive-backed false eyelashes. The adhesive-backed false eyelashes typically consist of a tape-like material with a plurality of eyelashes affixed thereto. The tape-like material can be applied to the user's eyelid to add the appearance of thick and full eyelashes.

A problem with adhesive-backed false eyelashes is that they typically do not look natural and because of their bulk, cannot be worn comfortably for extended periods of time.

Therefore, there is a continuing need for eyelash extensions that look natural and that can be worn comfortably for extended periods of time.

SUMMARY OF INVENTION

The present invention relates to a method for applying eyelash extensions to eyelashes. The method comprises acts of fastening a user's eyelashes against the user's face; and attaching multiple layers of eyelash extensions to the user's eyelashes. Each of the multiple layers is applied one layer at a time, thereby providing a user with eyelashes having eyelash extensions attached thereto.

The present invention further comprises an act of cleaning the user's eyelashes prior to the act of fastening the user's eyelashes against the user's face.

Additionally, the present invention further comprises an act of drying the user's eyelashes after cleaning the eyelashes.

In another aspect, the user has upper eyelashes, lower eyelashes, and an upper eyelid. Further, the act of fastening the user's eyelashes further comprises acts of: applying a patch underneath the user's lower eyelashes; fastening the user's lower eyelashes to the patch using a fastener; applying a fastener to the user's upper eyelid; and fastening the user's upper eyelashes to the upper eyelid using an eyelash fastener.

In yet another aspect, the act of attaching multiple layers of eyelash extensions further comprises acts of: removing a first layer of upper eyelashes from the eyelash fastener; attaching an eyelash extension to at least one eyelash of the first layer, where a single eyelash extension is attached to a single eyelash to form a first extended eyelash layer; fastening the first extended eyelash layer to the user using a fastener; removing a second layer of upper eyelashes from the eyelash fastener; and attaching an eyelash extension to at least one eyelash of the second layer, where a single eyelash extension is attached to a single eyelash to from a second extended eyelash layer.

Additionally, the act of attaching multiple layers of eyelash extensions further comprises acts of: fastening the second extended eyelash layer to the user using a fastener; removing a third layer of upper eyelashes from the eyelash fastener; and attaching an eyelash extension to at least one eyelash of the third layer, where a single eyelash extension is attached to a single eyelash to from a third extended eyelash layer.

The present invention further comprises an act of removing the fasteners from the eyelashes and extended eyelash layers.

Additionally, the present invention further comprises an act of fixing the eyelashes by performing an act selected from a group consisting of un-sticking any adjacently stuck eyelashes, attaching eyelash extensions to missed eyelashes, and adjusting eyelash extensions.

In another aspect, in the act of attaching multiple layers of eyelash extensions, the multiple layers are attached alternately between a first eye and a second eye, such that the first extended eyelash layer is applied to the first eye and then the second eye, with the second extended eyelash layer then being applied to the first eye and then the second eye, and with the third extended eyelash layer then being applied to the first eye then the second eye.

The present invention further comprise an act of comparing the eyelash extensions on the first eye with that of the second eye to ensure evenness, and if uneven, performing an act selected from a group consisting of attaching eyelash extensions, removing eyelash extensions, and adjusting eyelash extensions to correct the unevenness.

Additionally, the acts of applying a patch underneath the user's lower eyelashes and fastening the user's lower eyelashes to the patch, are performed while the user's eyes are open.

Finally, as can be appreciated by one in the art, the present invention also comprises a method for forming and using the eyelash extensions described herein.

BRIEF DESCRIPTION OF THE DRAWINGS

The objects, features and advantages of the present invention will be apparent from the following detailed descriptions of the various aspects of the invention in conjunction with reference to the following drawings, where:

FIG. 2A is a top-view illustration of a multi-pronged eyelash according to the present invention;

FIG. 2B is a top-view illustration of a multi-pronged eyelash according to the present invention;

FIG. 2C is a top-view illustration of a multi-pronged eyelash according to the present invention;

FIG. 2D is a top-view illustration of a multi-pronged eyelash according to the present invention, showing both left and right eyelashes;

FIG. 2E is a top-view illustration of a multi-pronged eyelash according to the present invention, showing both left and right eyelashes;

DETAILED DESCRIPTION

Figures 1A, 1B, 1C, 1D, 1E, 1F:
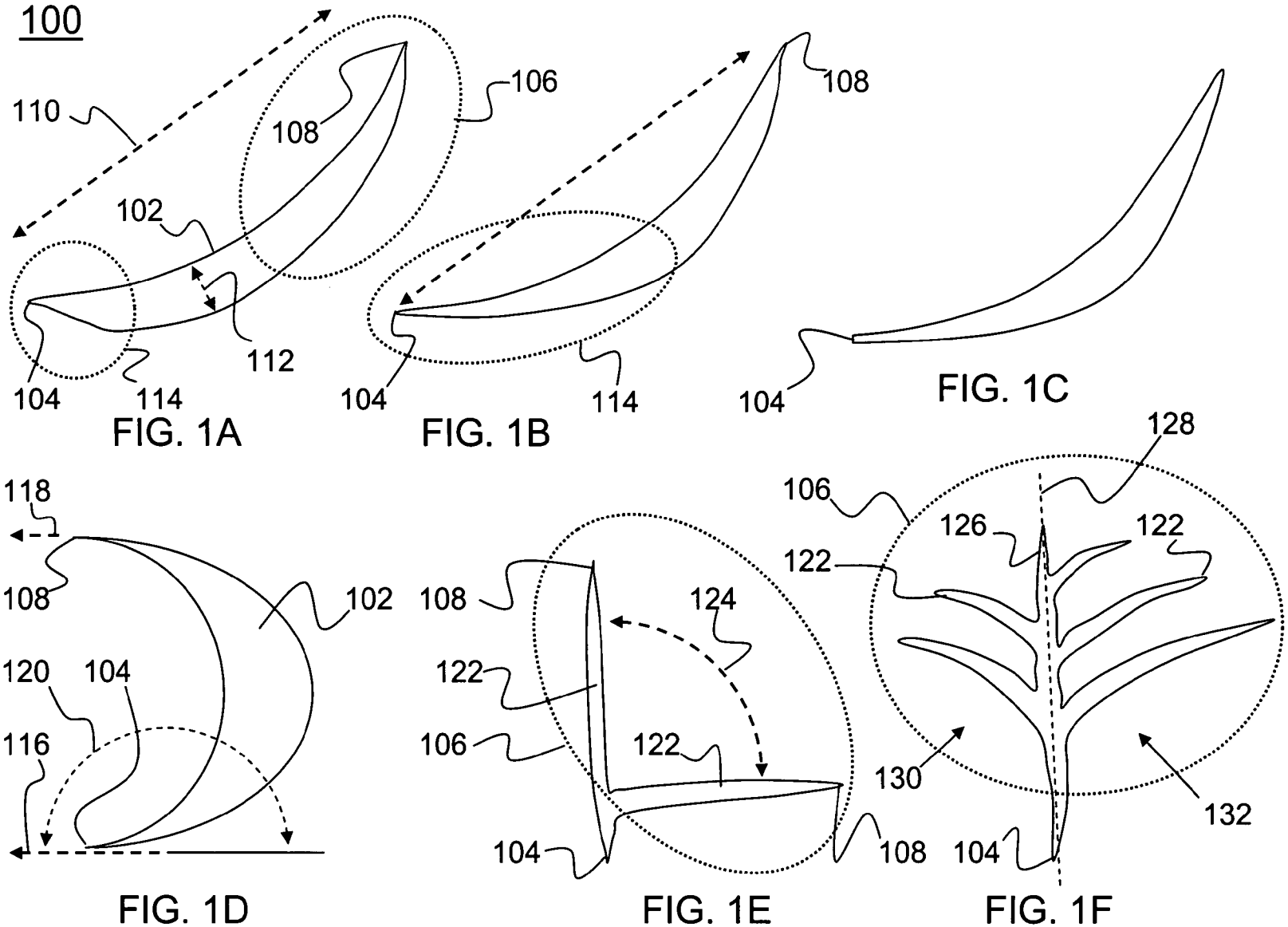
FIG. 1A is a side-view illustration of an eyelash extension according to the present invention.
FIG. 1B is a side-view illustration of an eyelash extension according to the present invention.
FIG. 1C is a side-view illustration of an eyelash extension according to the present invention.
FIG. 1D is a side-view illustration of an eyelash extension according to the present invention.
FIG. 1E is a top-view illustration of a multi-pronged eyelash according to the present invention.
FIG. 1F is a top-view illustration of a multi-pronged eyelash according to the present invention.

The present invention relates to false eyelashes, and more particularly to a method for applying eyelash extensions to a user's eyelashes. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

If used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to eyelash extensions and a method for applying the extensions. For clarity, exemplary eyelash extensions will be described first. Next, the method for applying the extensions will be described.

(1.1) Eyelash Extensions

In order to enhance the beauty of a user's eyelashes, users have traditionally applied adhesive-backed false eyelashes. As an improvement over the prior art, the present invention describes eyelash extensions that can be applied individually and directly to a user's eyelashes. As can be appreciated by one skilled in the art, the method described herein can be performed using a variety of eyelash extensions. The specific eyelash extensions described herein are for illustrative purposes only as the invention is not intended to be limited thereto.

As shown in FIG. 1A, the eyelash extensions 100 are formed of a filament 102 having both a proximal end 104 and a distal portion 106 with a distal end 108. The filament 102 is formed of any suitably durable yet flexible material, non-limiting examples of which include plastic, fiber, and a synthetic fiber. Each of the proximal end 104 and distal end 108 are tapered and are of a size such that the proximal end 104 can be attached with a single eyelash. As a non-limiting example, the filament 102 has a length 110 that is between approximately 2 and 30 millimeters (mm). As another non-limiting example, the filament 102 has a thickness 112 that is between approximately 0.01 and 0.9 mm.

As briefly mentioned above, the proximal end 104 is tapered to allow it to be affixed with a single eyelash (or small grouping of eyelashes). By being tapered, the eyelash extension 100 can be affixed with an eyelash to provide a natural look. Further, when applying the eyelash extensions 100, it is desirable that they stay affixed to the user for a period of time. While affixed to the user's lashes, the tapered proximal end 104 decreases the size of the lash that is actually proximate the user's skin, thereby increasing comfort. Additionally, as opposed to a blocky proximal end, the tapered proximal end 104 decreases the risk that the proximal end 104 will snag on an object (e.g., user's shirt) and thereby pull the eyelash extensions 100 from the user's eyelashes. Therefore, with a decreased risk that the eyelash extension 100 will snag on something, it is probable that the eyelash extension 100 will stay affixed with a user's eyelash for an extended period of time.

The proximal end 104 is tapered in any suitable form to provide the advantages above. As a non-limiting example, the filament 102 has a tapered portion 114 that is less than one half the length 110 of the filament 102, or more specifically, the tapered portion 114 is less than one quarter the length 110 of the filament 102.

As another non-limiting example, and as illustrated in FIG. 1B, the tapered portion 114 is spread along more of the length 110 of the filament. Additionally, as shown in FIGS. 1A and 1B, each of the proximal end 104 and distal end 108 are tapered to a point. In another aspect and as shown in FIG. 1C, the proximal end 104 is tapered to a blunt tip. As can be appreciated by one skilled in the art, whether formed as a point or a blunt tip, the proximal end 104 is tapered to increasingly decrease its circumference to provide the benefits described above.

FIG. 1D illustrates an eyelash extension 100 depicting a range of flares. In other words, the proximal end 104 points in a first direction 116 and the distal end 108 points in a second direction 118. A flare angle 120 exists between the first direction 116 and the second direction 118. The filament 102 is flared with the flare corresponding to the flare angle 120 between the first direction 116 and the second direction 118. Although the flare angle 120 is illustrated as 180 degrees, one skilled in the art can appreciate that the flare angle 120 can be substantially less or more than 180 degrees. The flare is to any degree provided that it is still comfortable for the user, a non-limiting example of which includes being less than or equal to 360 degrees. As another non-limiting example, the flare is less than or equal to 180 degrees.

In addition to a single distal end, and as shown in FIG. 1E, the distal portion 106 can be branched to further include a plurality of branches 122. In this aspect, each branch 122 has a distal end 108 such that the filament 102 with the proximal end 104 and plurality of branches 122 forms a branched eyelash extension. The branches 122 provide a user with an appearance of having thick and full eyelashes (appearing to have more eyelashes than they actually do). A branch angle 124 exists between each of the branches 122. The branch angle 124 is to any degree that provides a pleasantly aesthetic look to the user yet still remains comfortable to wear. As a non-limiting example, the branch angle 124 is less than or equal to 180 degrees. Further, the branch angle 124 can be the same or vary between adjacent branches 122 on the eyelash extension 100.

As can be appreciated by one skilled in the art, the number of branches 122 and their various branch angles 124, flare angles 120, lengths and thicknesses can be altered to provide a variety of looks. By way of example and as illustrated in FIG. 1F, the distal portion 106 includes an aligned branch 126 that is in approximate axial alignment with the proximal end 104. The number of branches 122 on each side of the aligned branch 126 can be altered as desired. As a non-limiting example, the number of branches 122 on a first side 130 of the aligned branch 126 is different than the number of branches 122 on a second side 130 of the aligned branch 126. As another non-limiting example and as illustrated in FIGS. 2A and 2B, the number of branches 122 on either side of the aligned branch 126 is equal. As can be appreciated by one skilled in the art, it is not a requisite that at least one branch be in axial alignment with the proximal end 104. The branches 122 can be staggered such that no branch 122 is in axial alignment with the proximal end 104.

As shown in FIG. 2C, each of the branches 122 has a length 200. The lengths 200 of the branches 122 can be altered to provide a variety of effects. As a non-limiting example, the lengths 200 of each branch are the same. As another non-limiting example, the length 200 of at least one branch 122 is different than the length 200 of at least one other branch 122. For example, it may be desirable to have longer lashes on the branch 122 that is going to be placed as the outer-most branch 122 on the corner of the user's eye.

Furthermore, each branch 122 has a thickness 202. Altering the thickness 202 of the branches 122 provides for a variety of aesthetic appearances when applied to a user. For example, the thickness 202 of each branch 122 can be the same, or alternatively, the thickness 202 of one branch 122 may be different than the thickness 202 of at least one other branch 122. As a non-limiting example, the branches 122 that are to be positioned toward the corner of a user's eye may be thicker than those that are positioned away from the corner of the eye.

Additionally, each branch 122 has a flare (as described above). The flare on each branch 122 of the eyelash extension 100 can be either the same or different. In some applications, it may be desirable to have an eyelash extension 100 with branches 122 having varying flares. As a non-limiting example, the branches 122 that are to be positioned toward the corner of a user's eye may have a flare with a lower degree than those that are positioned away from the corner of the eye. By having a flare angle with a decreased degree, the branch 122 would extend further out without rolling back towards the user's face. Such an extended branch 122 would provide an appearance of broader eyelashes.

In another aspect, the filament 102 of the eyelash extension 100 is colored. The color is any suitable color to provide an affect desired by the user. Non-limiting examples of such colors include blue, black, yellow, red, white, or any color resulting from a combination thereof, including multi-colored. Each of the branches 122 can be formed to have a similar color, or alternatively, each of the branches 122 is colored such that the color of at least one branch is different than that of at least one other branch. In another aspect, each branch 122 has a different color.

In another aspect and as shown in FIGS. 2D and 2E, the present invention also includes a second filament 204. Each of the filaments 102 and 204 can be formed to be attached with the user's first eye (e.g., left eye) and second eye (e.g., right eye) respectively. In this aspect, the flare angle 120 and branch angle 124 of the second filament 204 is a mirror image of those of the first filament 102. Thus, the first filament 102 is formed to be attached with first eye while the second filament 204 is formed to be attached with the second eye.

Based on the above, and as can be appreciated by one skilled in the art, the eyelash extension 100 can have a single distal end 108 or a plurality of branches 122 with varying branch angles, flare angles, thickness, lengths, colors, and positions of branches 122 to provide a variety of benefits and appearances.

(1.2) Method for Applying Eyelash Extensions

Figure 3:
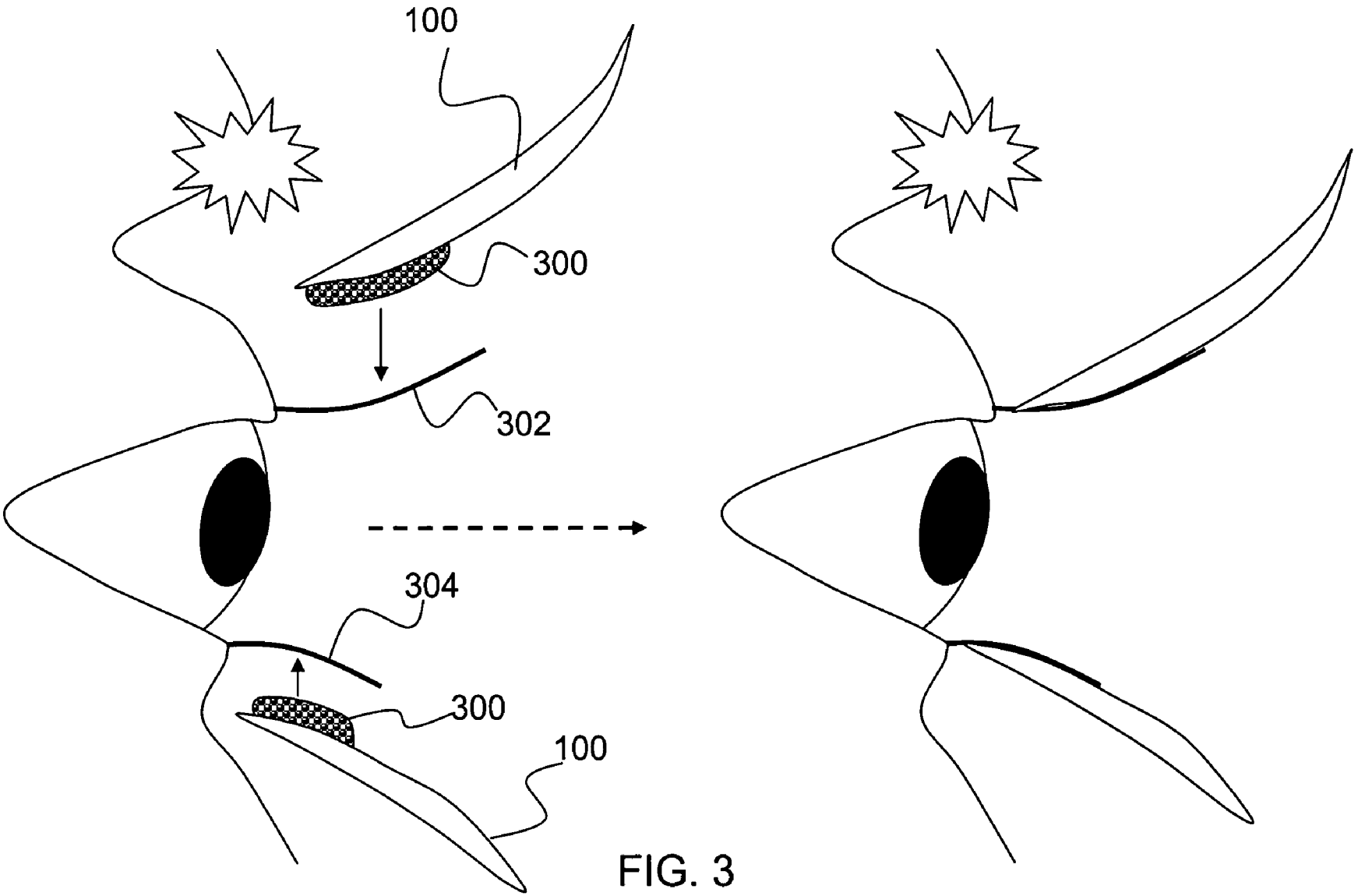
FIG. 3 is an illustration depicting eyelash extensions being attached with a user's eyelashes.

The present invention includes a method for applying eyelash extensions. As shown in FIG. 3, individual eyelash extensions 100 are applied to a user's eyelashes using an adhesive 300 (e.g., a glue). The eyelash extensions 100 can be applied to both the user's upper eyelashes 302 and/or lower eyelashes 304. As can be appreciated by one skilled in the art, although the eyelash extensions 100 are applied individually, if desired, they can be applied in groups to a single eyelash. Or alternatively, a single eyelash extension 100 can be applied to multiple eyelashes. However, in most cases it is desirable to have a single eyelash extension 100 attached to a single eyelash.

The method for applying eyelash extensions includes a plurality of acts to attach multiple layers of eyelash extensions to the user's eyelashes. Before the eyelash extensions are applied, the user's eyelashes are cleaned using water or a cleaning solution. The eyelashes are then air-dried or dried using a fan or other drying mechanism.

Figure 4:
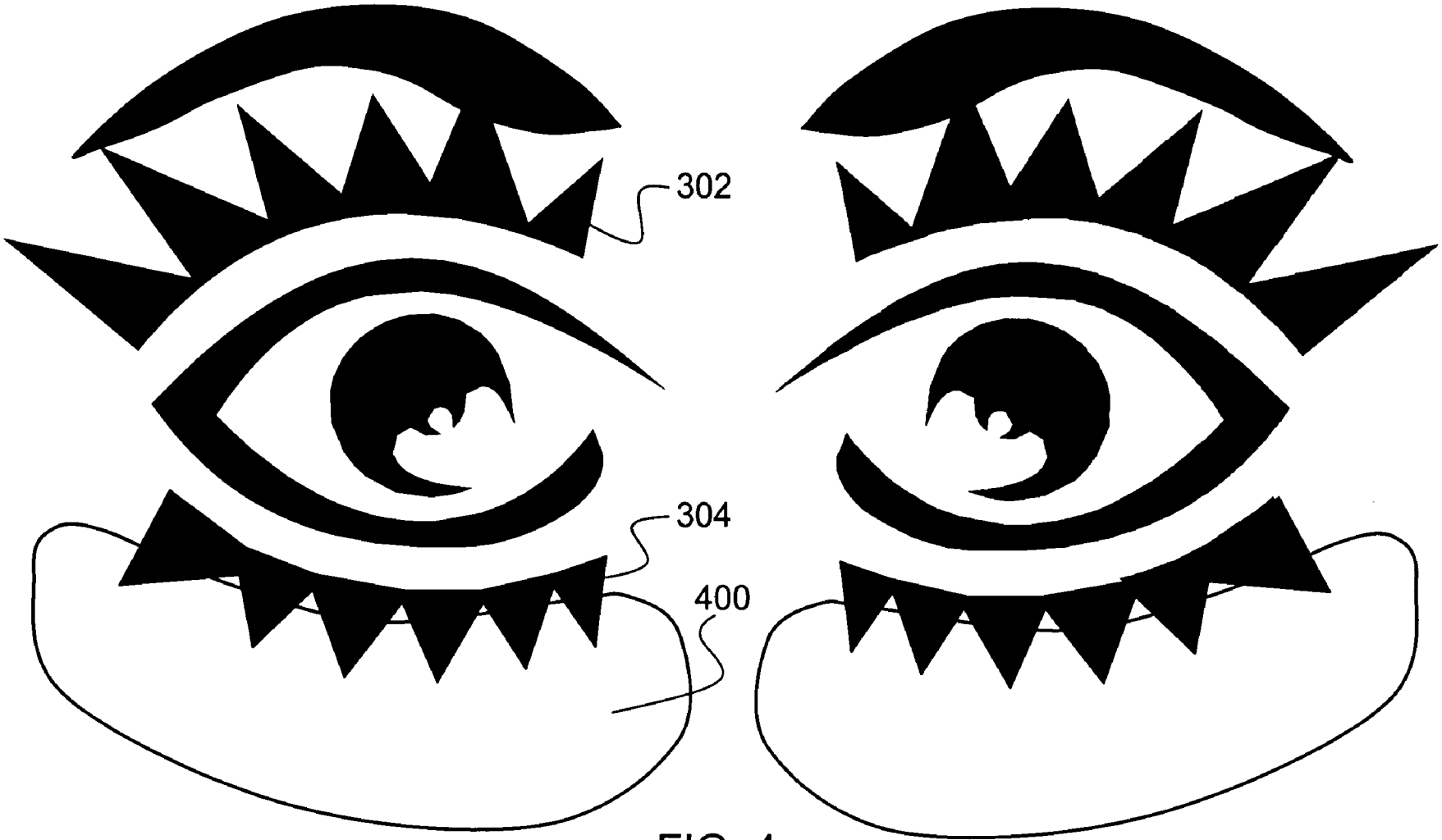
FIG. 4 is an illustration depicting a pad being affixed below the user's bottom eyelashes.

As shown in FIG. 4, after drying the eyelashes 302 and 304, a patch 400 is affixed to the user below the lower eyelashes 304. The patch 400 is any mechanism or device for creating a barrier upon the surface of the user's skin, non-limiting examples of which include a gel patch and tape.

Figure 5:
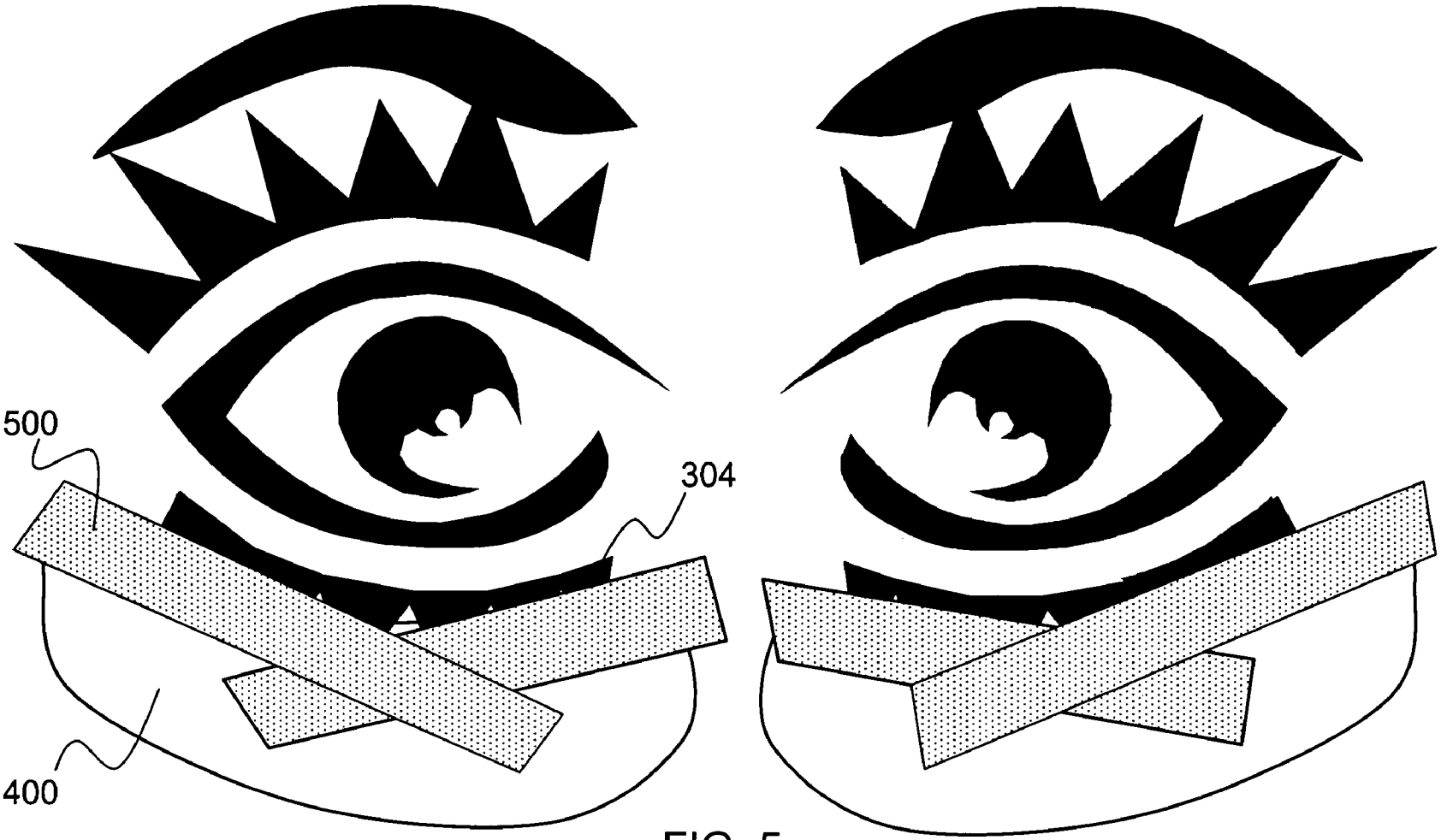
FIG. 5 is an illustration depicting the placement of tape over the user's bottom eyelashes.

As shown in FIG. 5, the lower eyelashes 304 are then fastened to the patch 400 using a fastener 500. It should be noted that the user's eyes are typically open at this point. However, this act can also be performed while the eyes are closed, or with one eye closed while the other is open. The fastener 500 is any mechanism or device for fastening one object against another, a non-limiting example of which includes tape.

Figure 6:
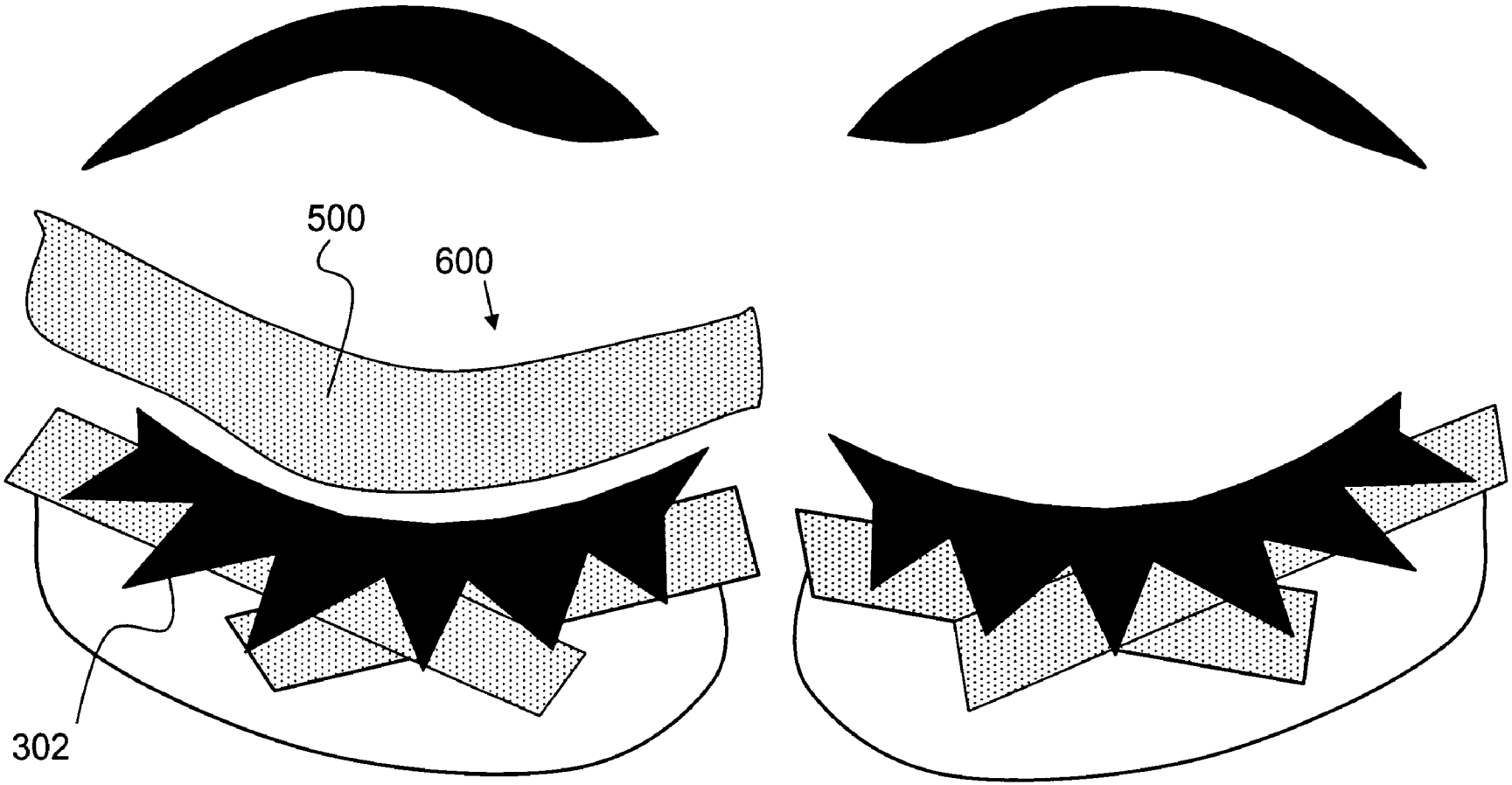
FIG. 6 is an illustration depicting the placement of tape over the user's top eyelid.

As shown in FIG. 6, with the user's eyes closed, a fastener 500 is applied to the user's upper eyelid 600. The fastener 500 is used to fasten the eyelid closed in order to prevent the user from opening the eye during treatment. The fastener 500 on the upper eyelid 600 provides additional benefits. For example, when taping up the upper eyelashes 302 (as described below), the eyelashes are prevented from touching the user's eyelid 600 (skin), thereby decreasing the risk of contaminating the eyelashes with oil from the user's skin. Additionally, when separating the eyelashes (as described below), tools used to separate the eyelashes do not touch the user's skin (increasing comfort).

Figure 7:
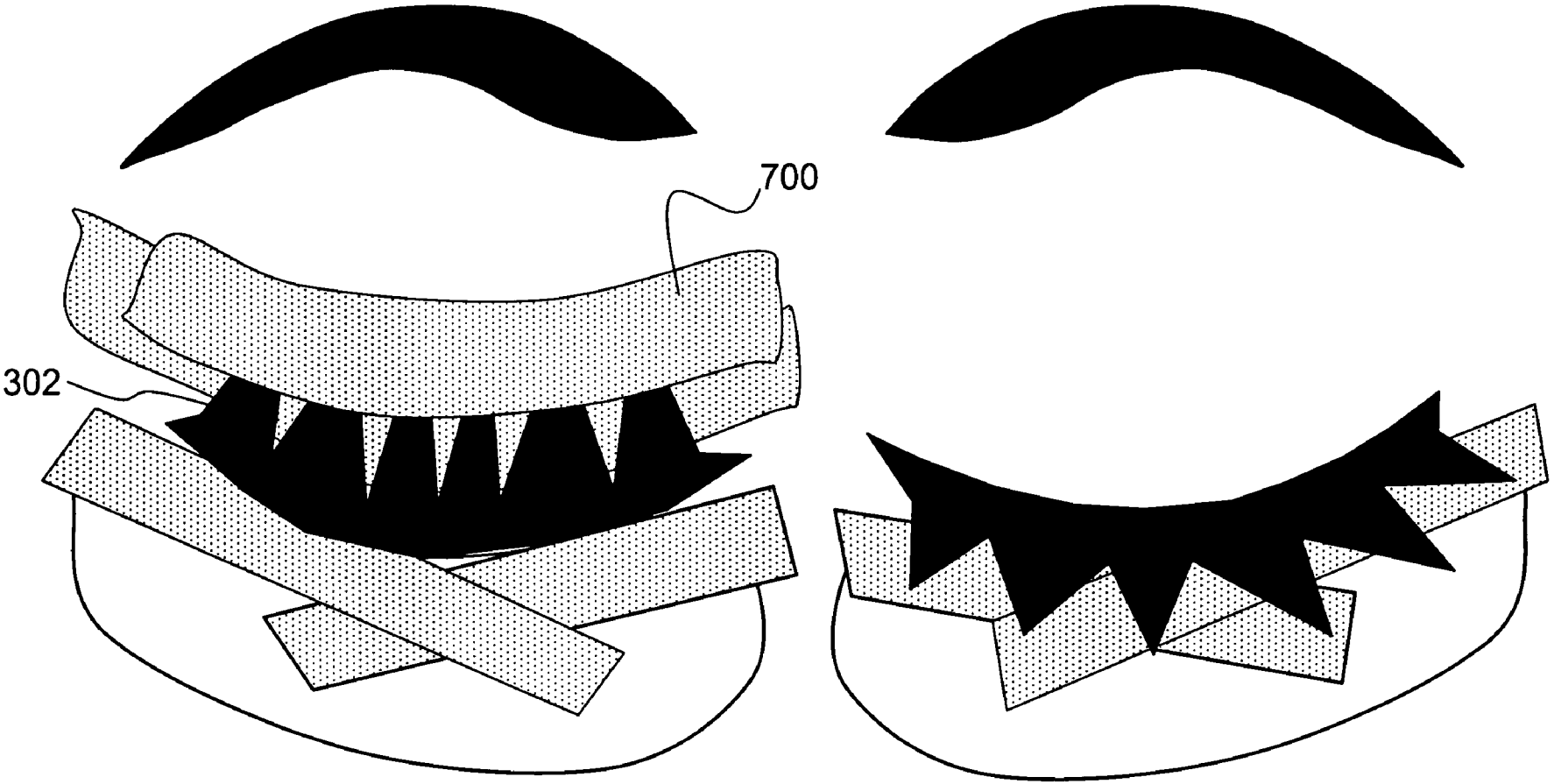
FIG. 7 is an illustration depicting the top eyelashes of a user being taped up.

As shown in FIG. 7, the upper eyelashes 302 are then fastened to the upper eyelid 600 using an eyelash fastener 700 (such as tape).

Figure 8:
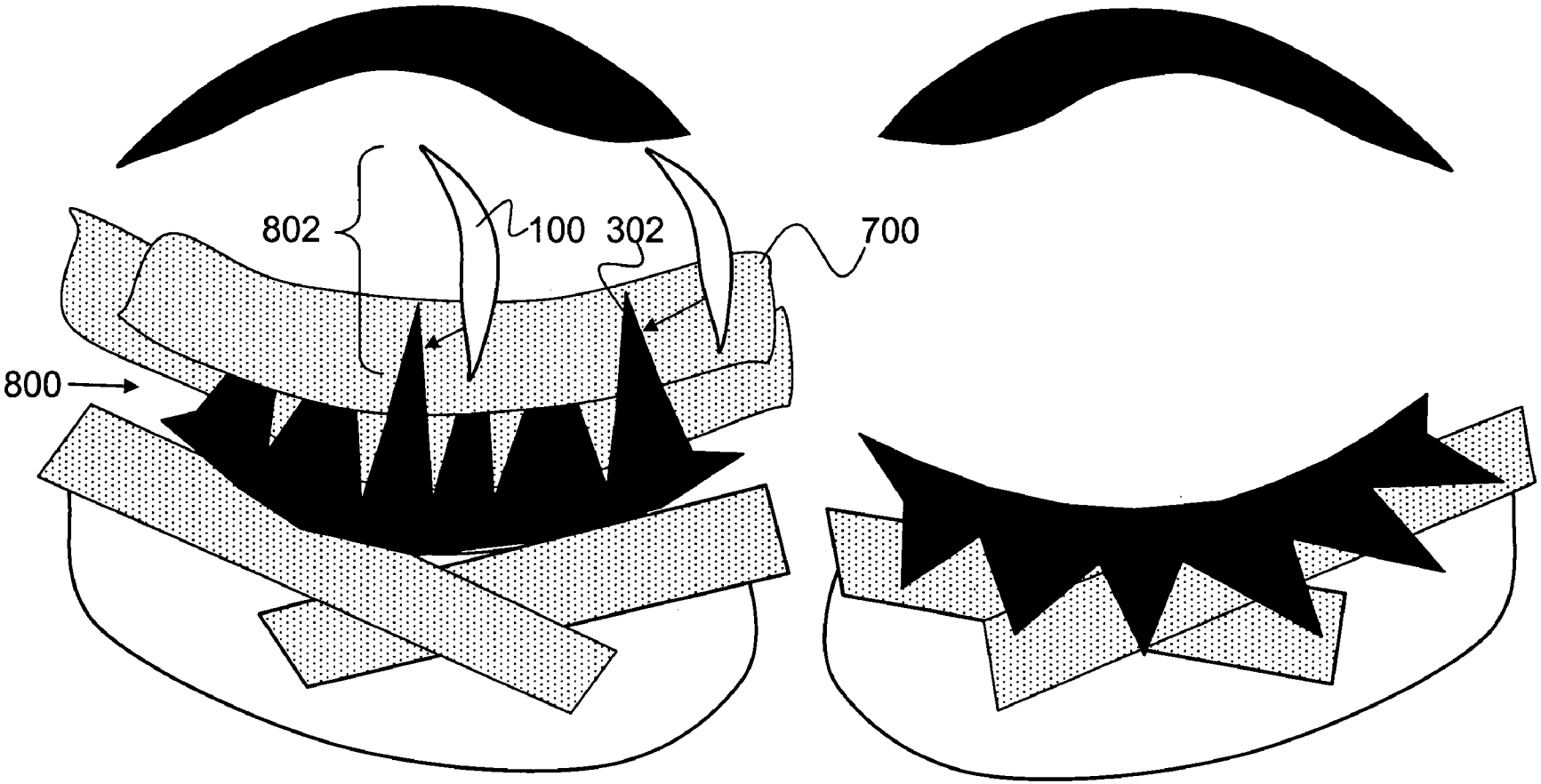
FIG. 8 is an illustration depicting eyelash extensions being affixed to the user's eyelashes.

As shown in FIG. 8, a first layer of upper eyelashes 302 is removed from the eyelash fastener 700 on the user's first eye 800. The upper eyelashes 302 are removed by hand or using any suitable tool, such as tweezers. After a first layer of upper eyelashes 302 has been freed from the eyelash fastener 700, eyelash extensions 100 are attached with the eyelashes 302 to create a first extended eyelash layer 800. The eyelash extensions 100 are attached one-by-one to individual eyelashes 320 using glue or any other suitable adhesive. Although not limited thereto, short eyelash extensions 100 (e.g., 6-9 mm) are typically attached with the inner corner of the user's eye, while long eyelash extensions (e.g., 7-15 mm) are attached to the middle or outer corner of the user's eye.

Figure 9:
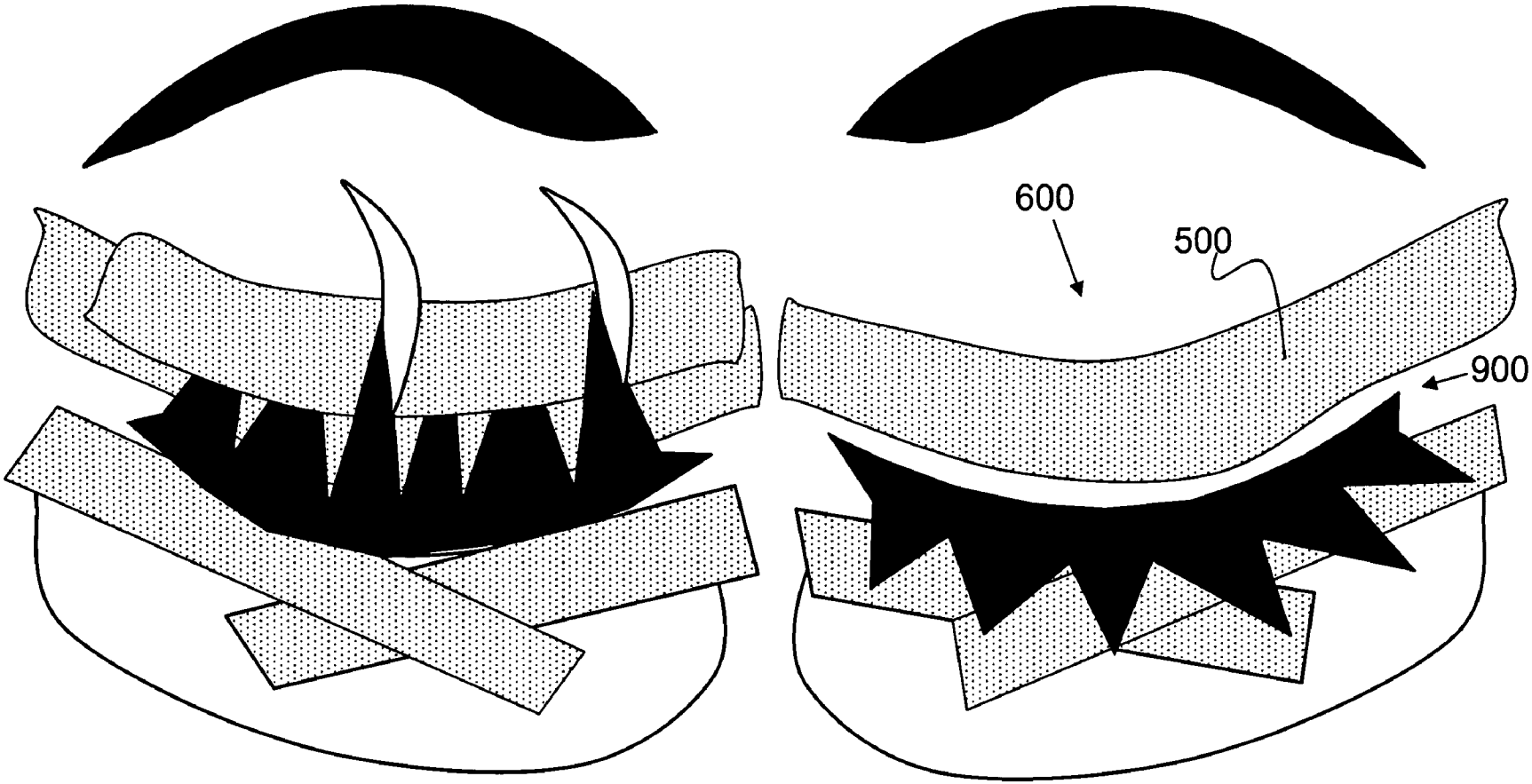
FIG. 9 is an illustration depicting eyelash extensions affixed to the user's eyelashes.
Figure 10:
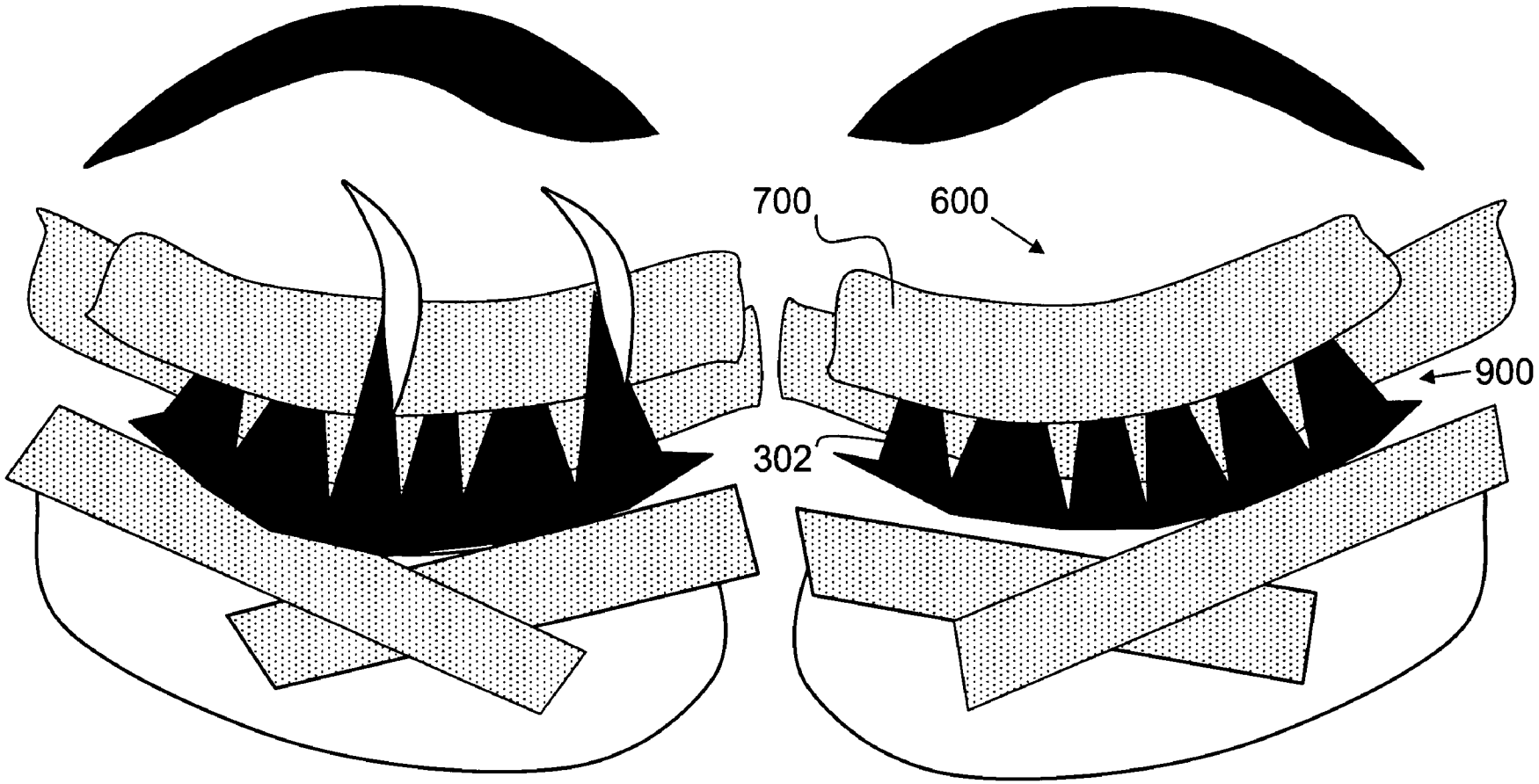
FIG. 10 is an illustration depicting the user's other top eyelashes being taped up.

As shown in FIG. 9, a fastener 500 is applied to the eyelid 600 of the user's second eye 900. As illustrated in FIG. 10, using an eyelash fastener 700, the user's upper eyelashes 302 are then fastened to the upper eyelid 600 of the user's second eye 900.

Figure 11:
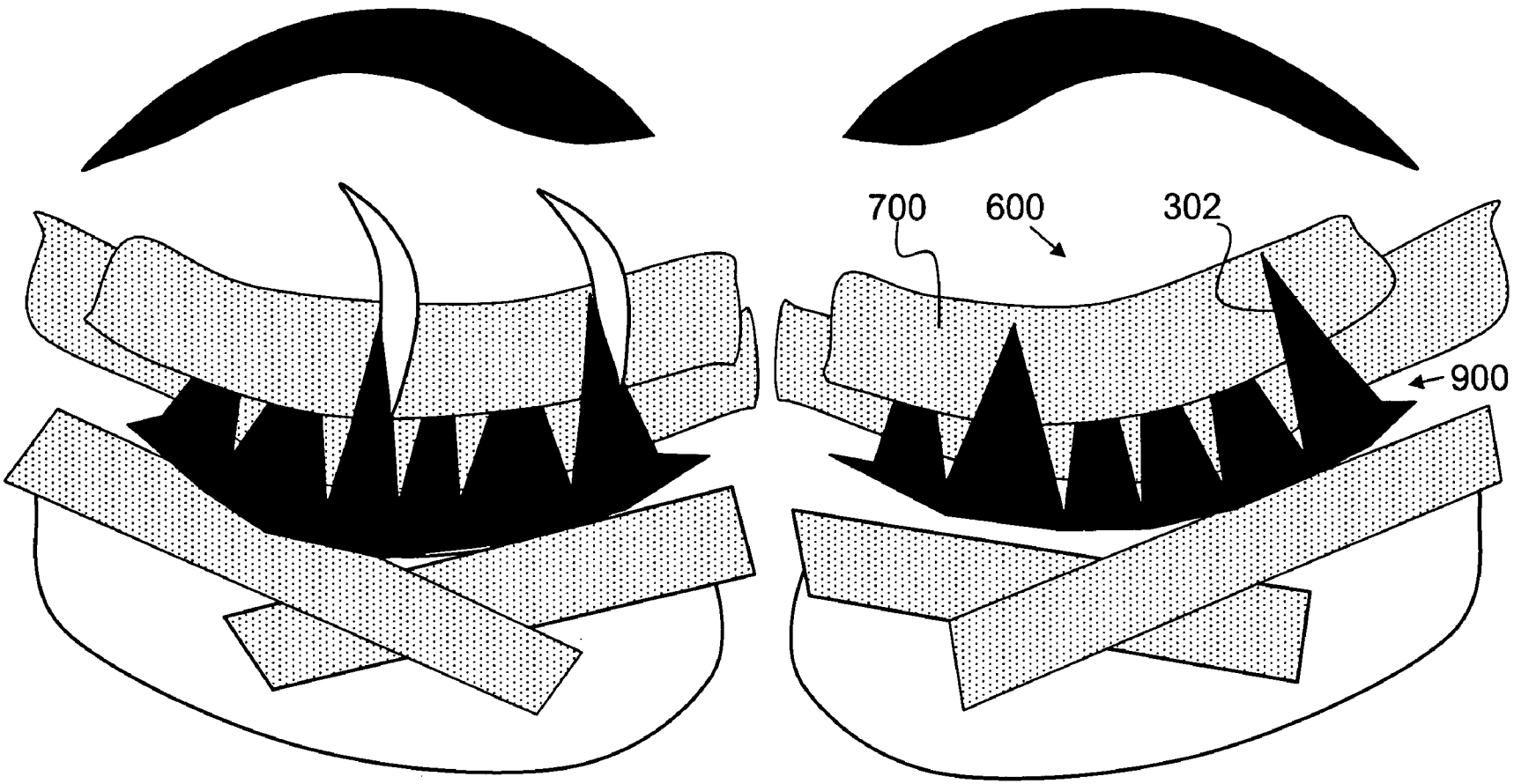
FIG. 11 is an illustration depicting the user's eyelashes being pulled from the tape.
Figure 12:
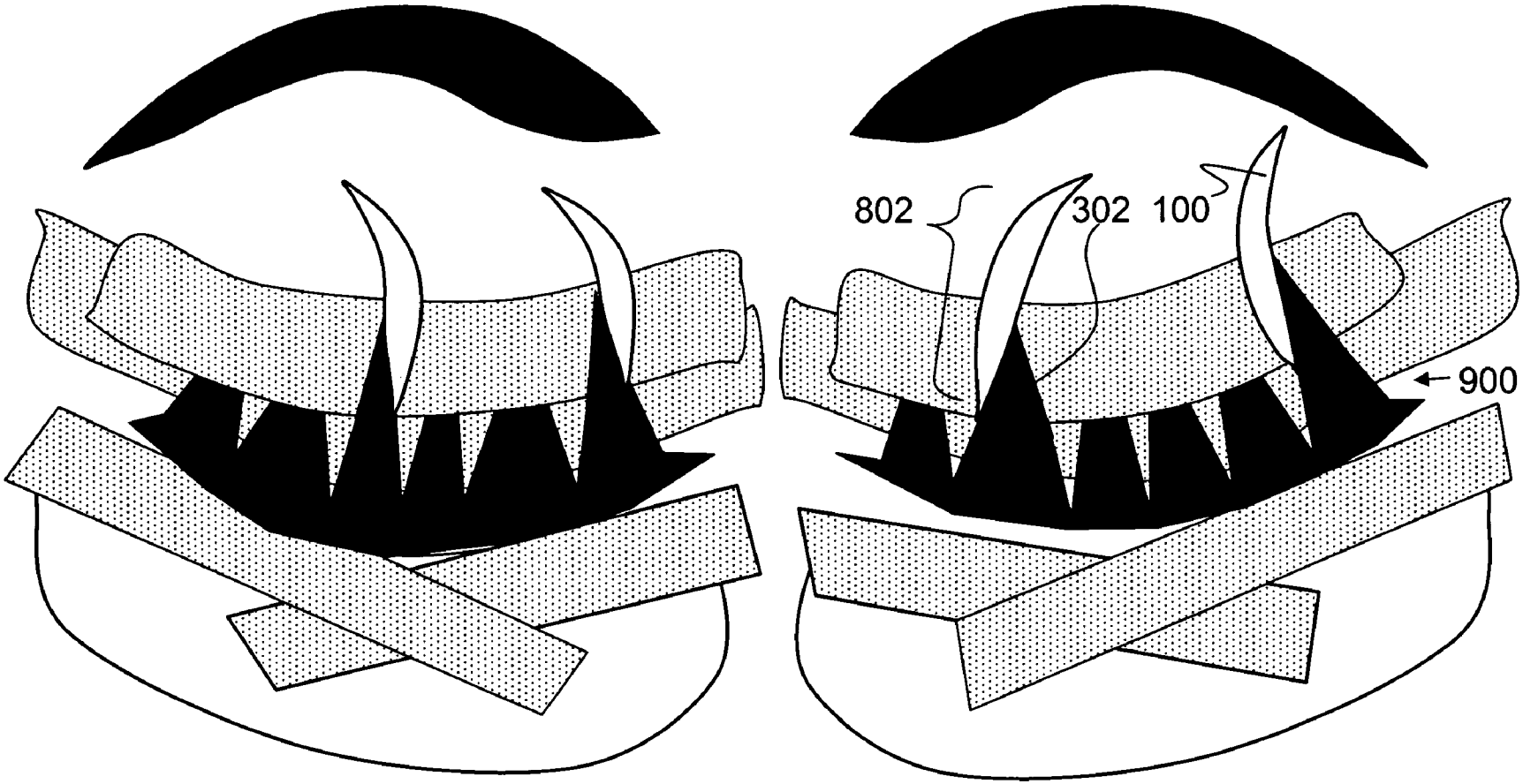
FIG. 12 is an illustration depicting eyelash extensions affixed to the user's eyelashes.

As shown in FIG. 11, a first layer of upper eyelashes 302 is removed from the eyelash fastener 700 of the user's second eye 900. Thereafter, as illustrated in FIG. 12, eyelash extensions 100 are attached with the freed eyelashes 302, thereby creating a first extended eyelash layer 802 on the user's second eye 900.

Figure 13:
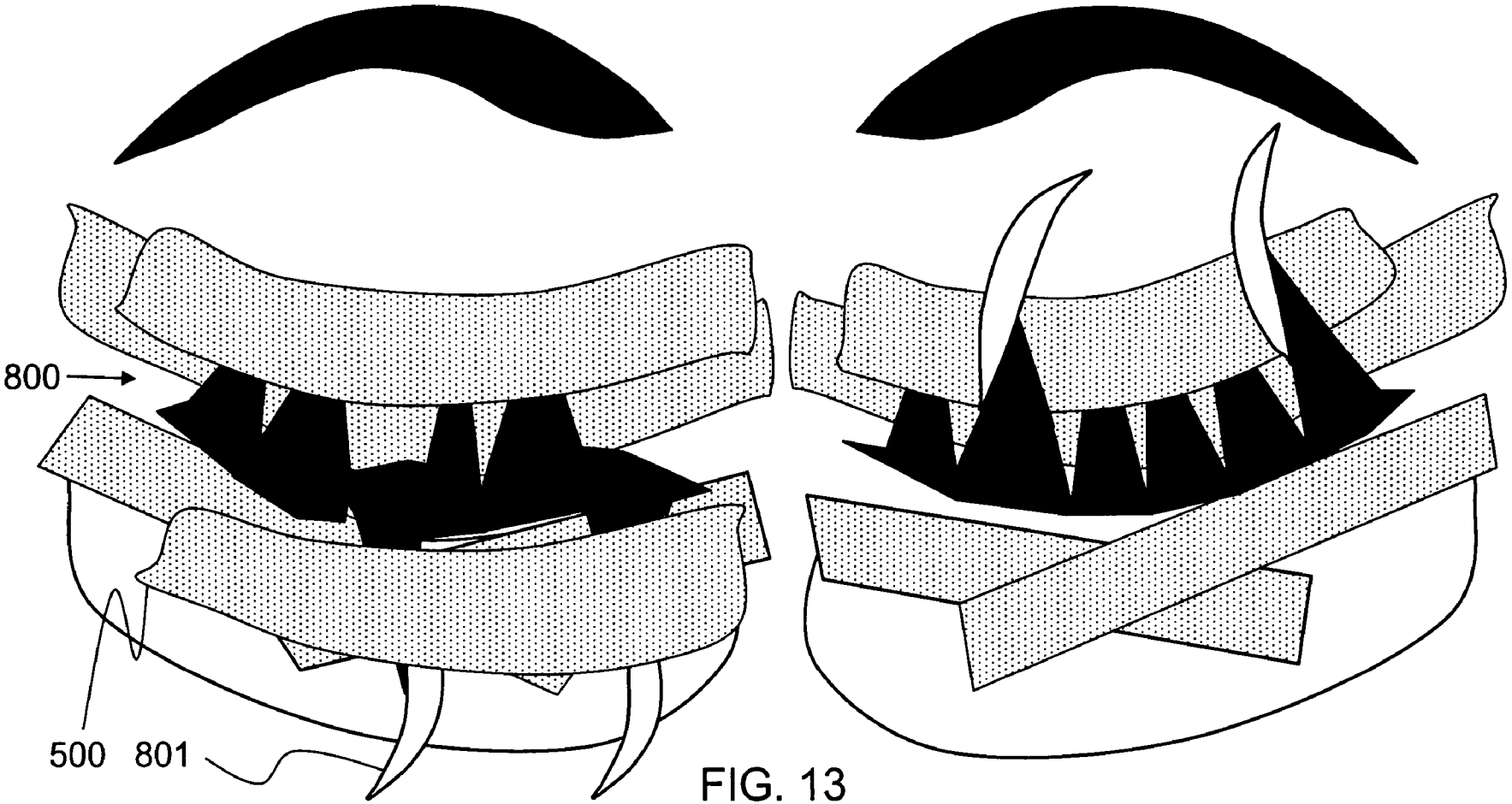
FIG. 13 is an illustration depicting the eyelashes with extensions being taped down.
Figure 14:
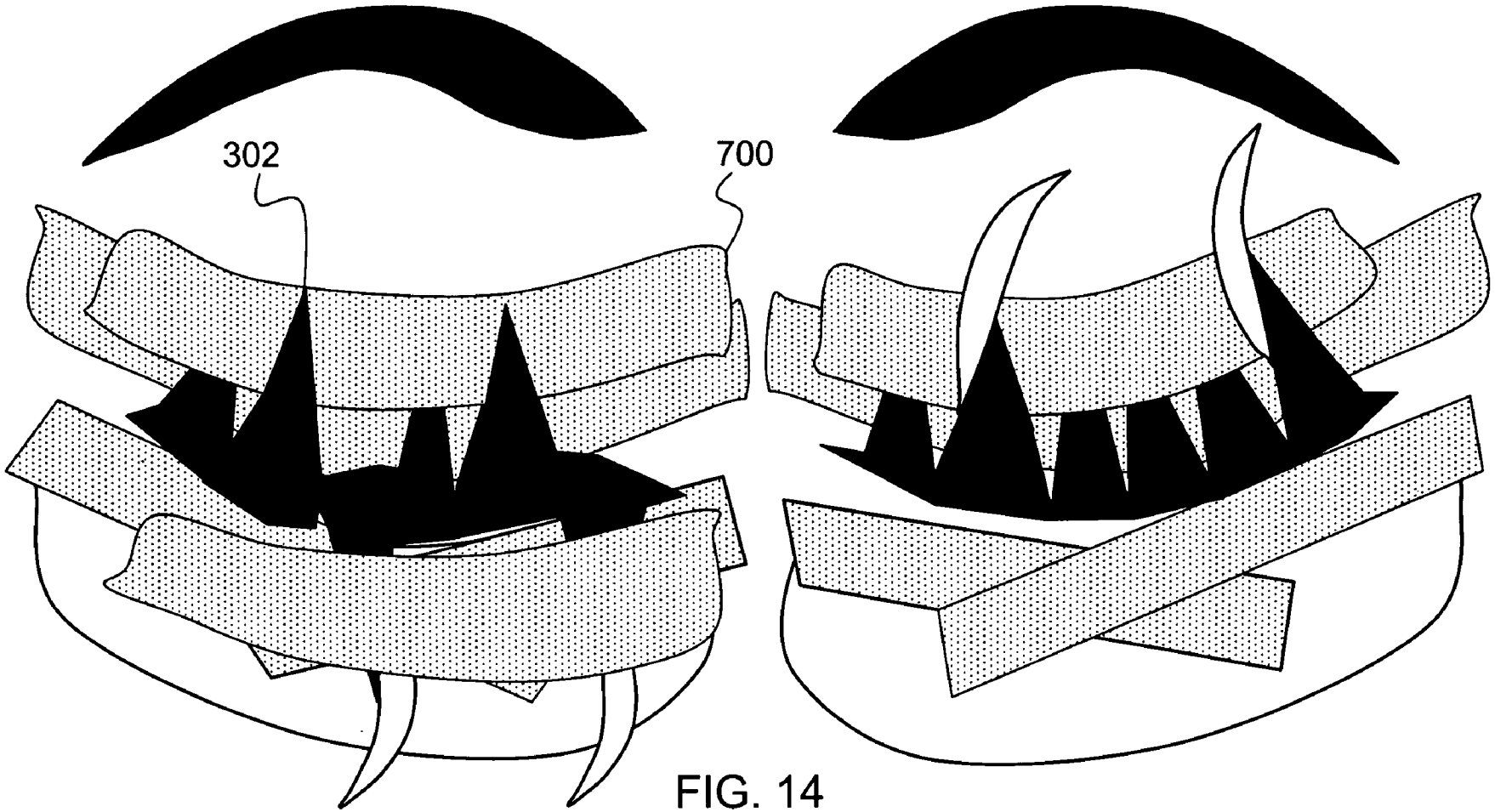
FIG. 14 is an illustration depicting the user's eyelashes being pulled from the tape.
Figure 15:
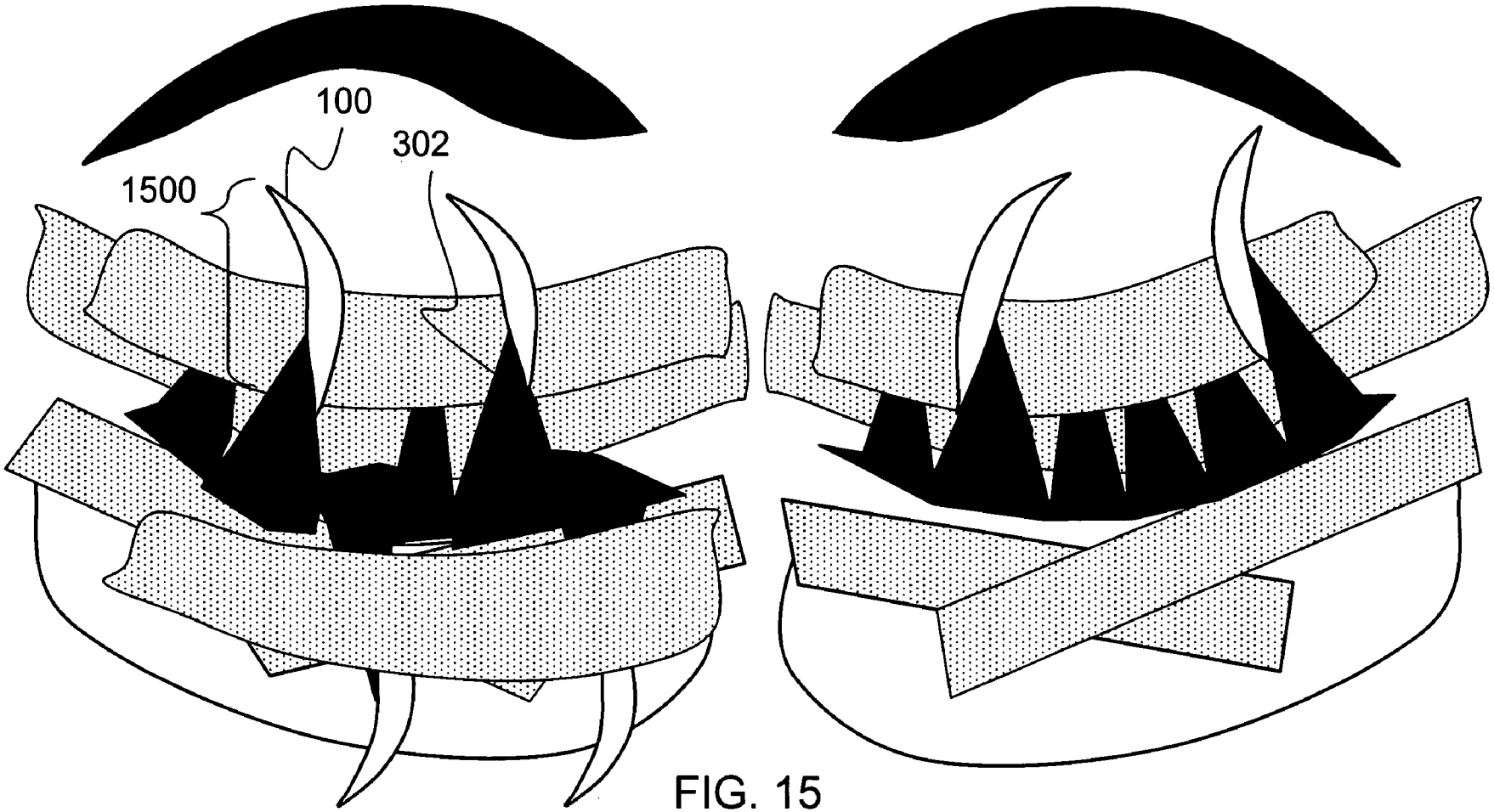
FIG. 15 is an illustration depicting eyelash extensions being affixed to the user's eyelashes.

As shown in FIG. 13, a fastener 500 is then used to fasten the first extended eyelash layer 802 to the user, such as below the user's first eye 800. Next, as shown in FIG. 14, a second layer of upper eyelashes 302 is removed from the eyelash fastener 700. Thereafter, as show in FIG. 15, eyelash extensions 100 are attached with the eyelashes 302 to form a second extended eyelash layer 1500.

Figure 16:
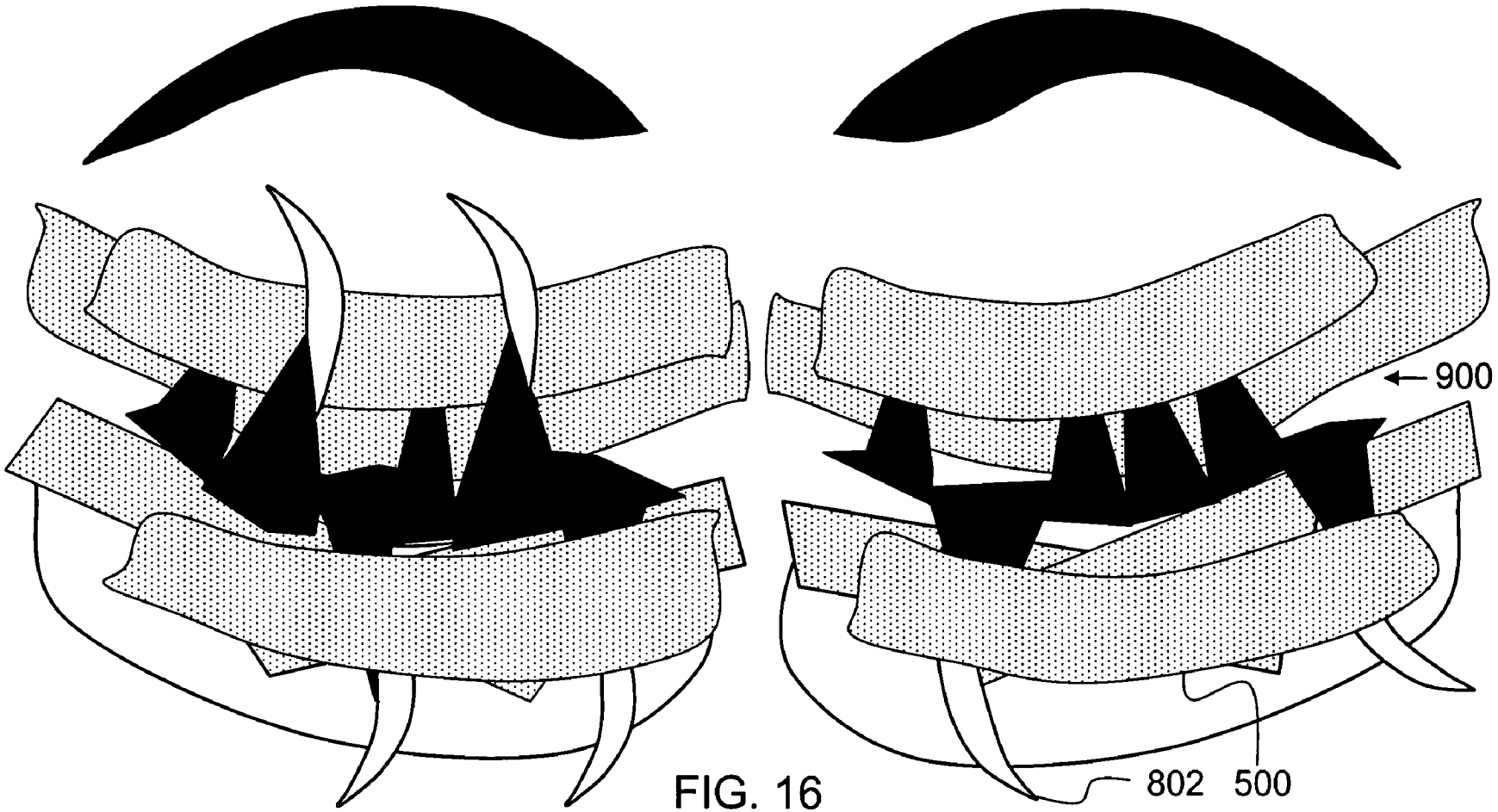
FIG. 16 is an illustration depicting the user's eyelashes with extensions being taped down.
Figure 17:
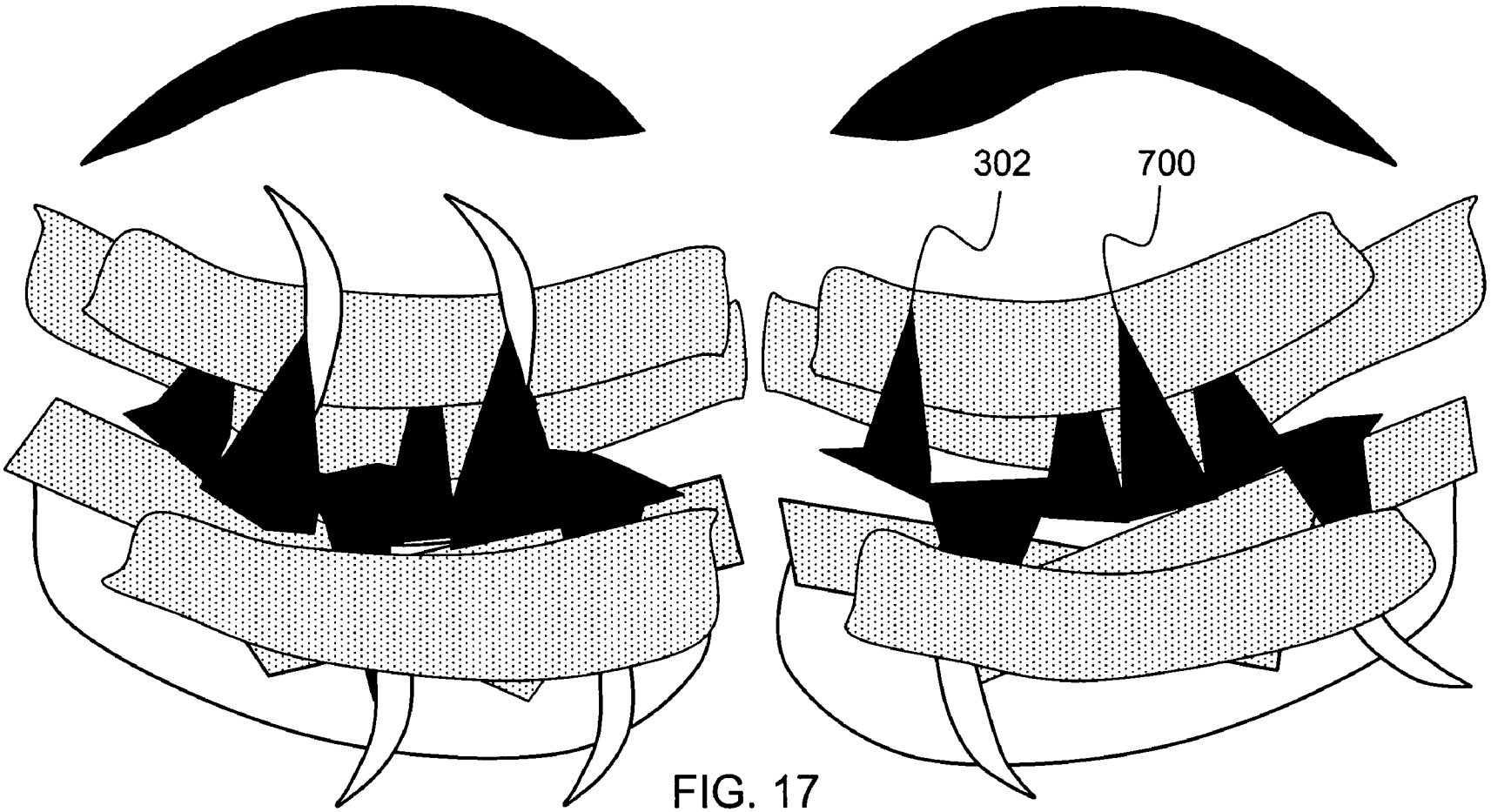
FIG. 17 is an illustration depicting the user's eyelashes being pulled from the tape.
Figure 18:
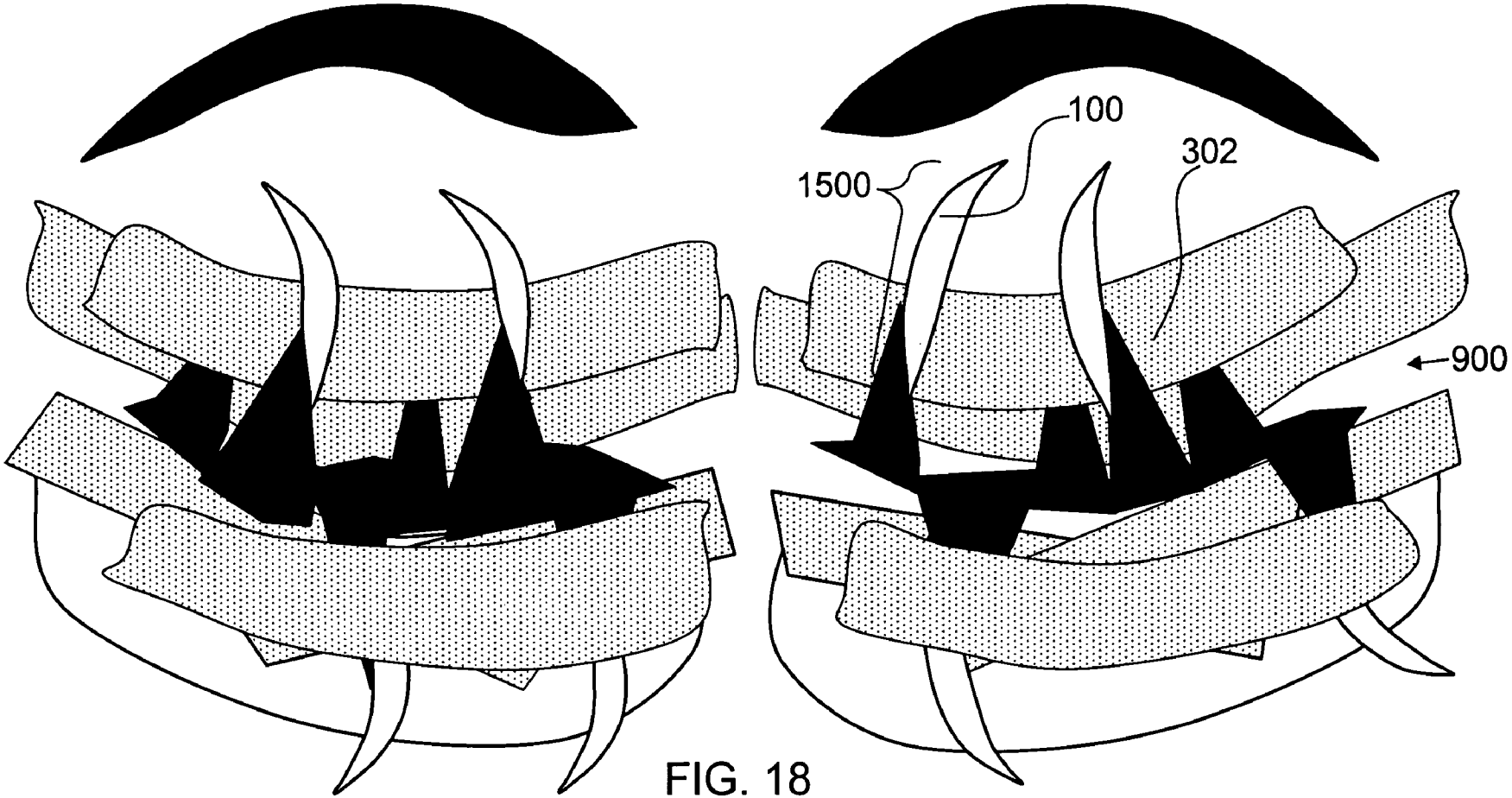
FIG. 18 is an illustration depicting eyelash extensions being affixed to the user's eyelashes.

Next, as shown in FIG. 16, a fastener 500 is used to fasten the first extended layer 802 to the user, such as below the user's the second eye 900. As shown in FIG. 17, a second layer of upper eyelashes 302 is then removed from the eyelash fastener 700. As shown in FIG. 18, eyelash extensions 100 are thereafter attached with the eyelashes 302 to form the second extended eyelash layer 1500 for the user's second eye 900.

Figure 19:
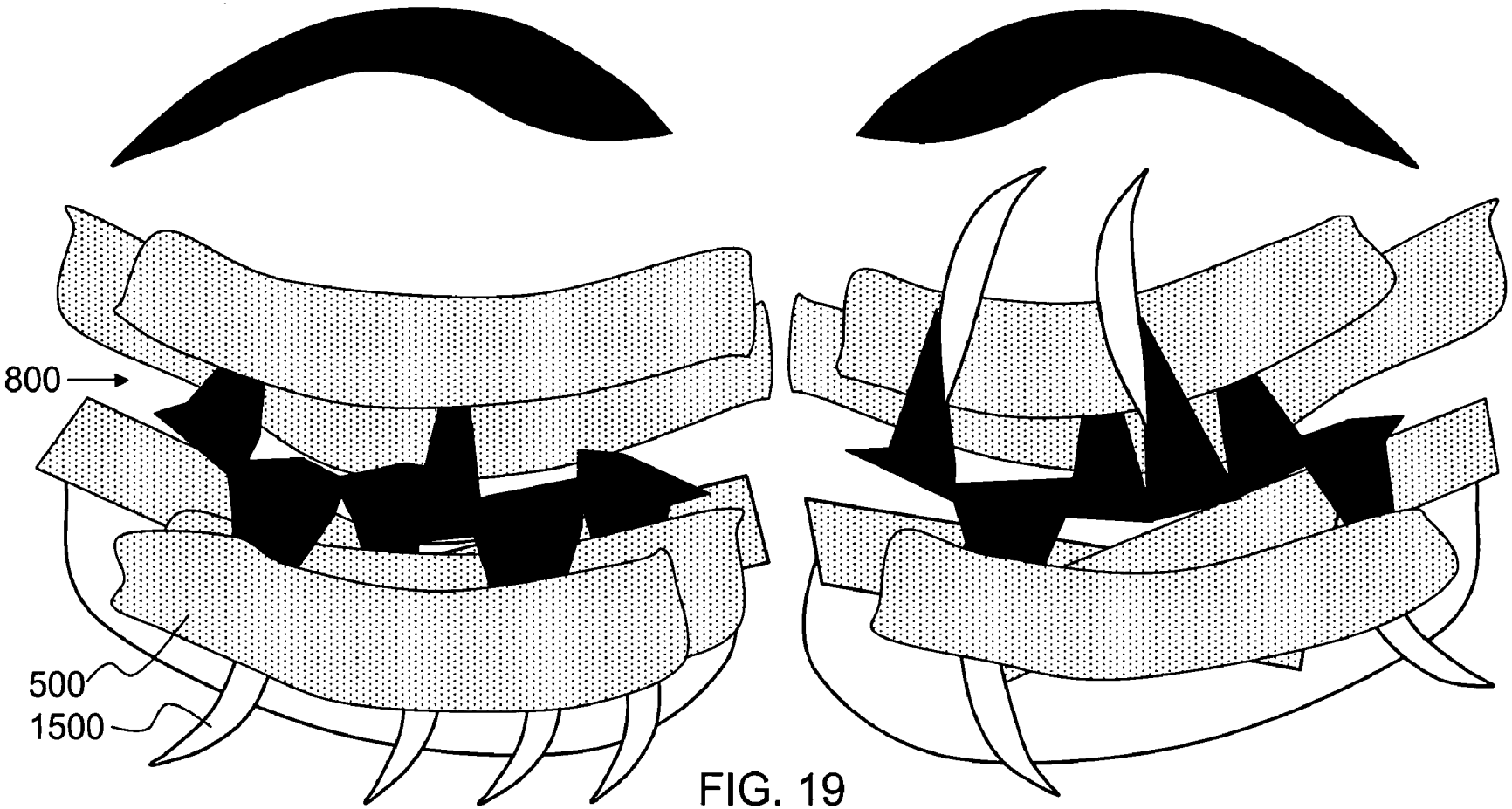
FIG. 19 is an illustration depicting the user's eyelashes with extensions being taped down.
Figure 20:
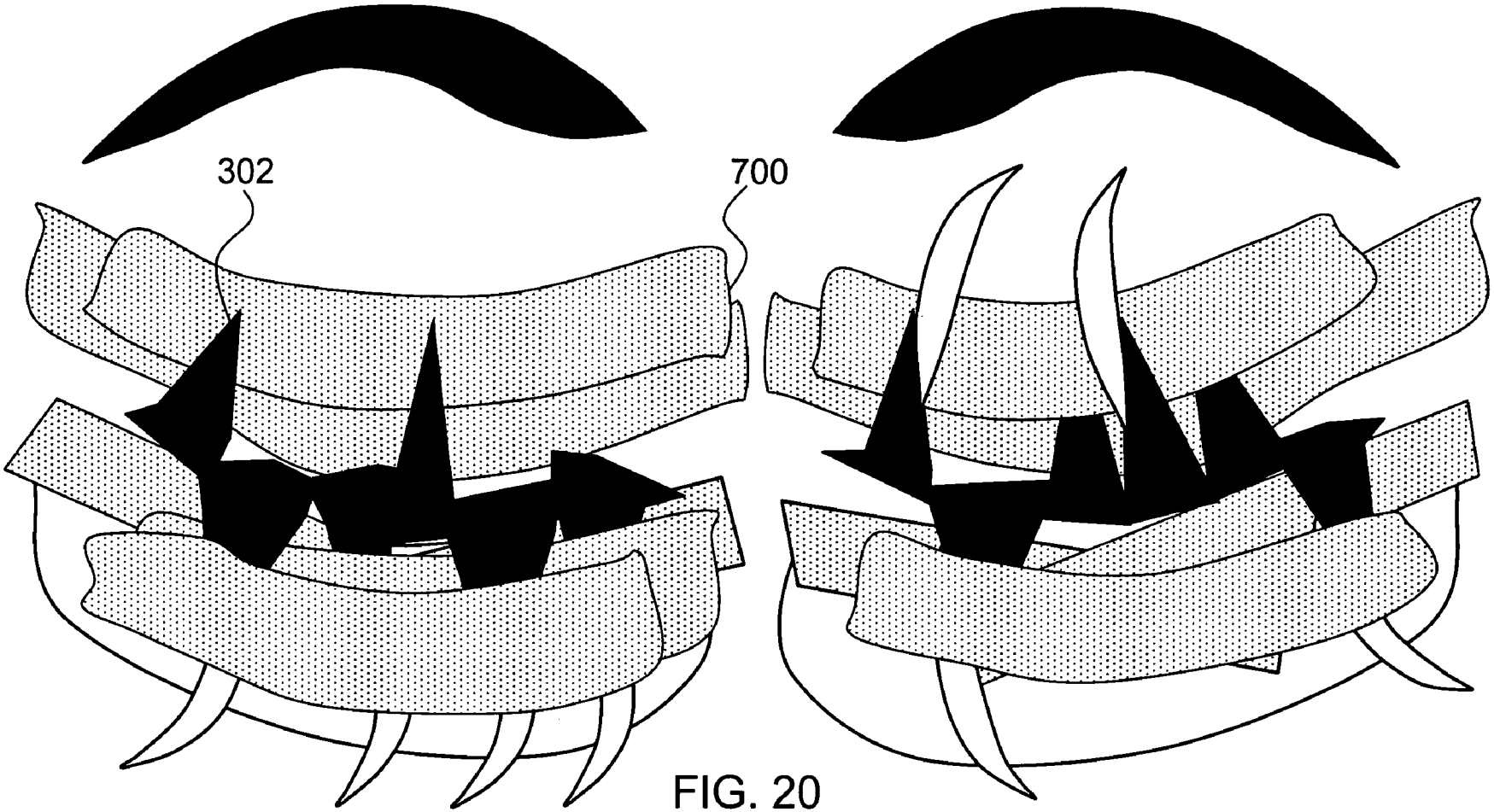
FIG. 20 is an illustration depicting the user's eyelashes being pulled from the tape.
Figure 21:
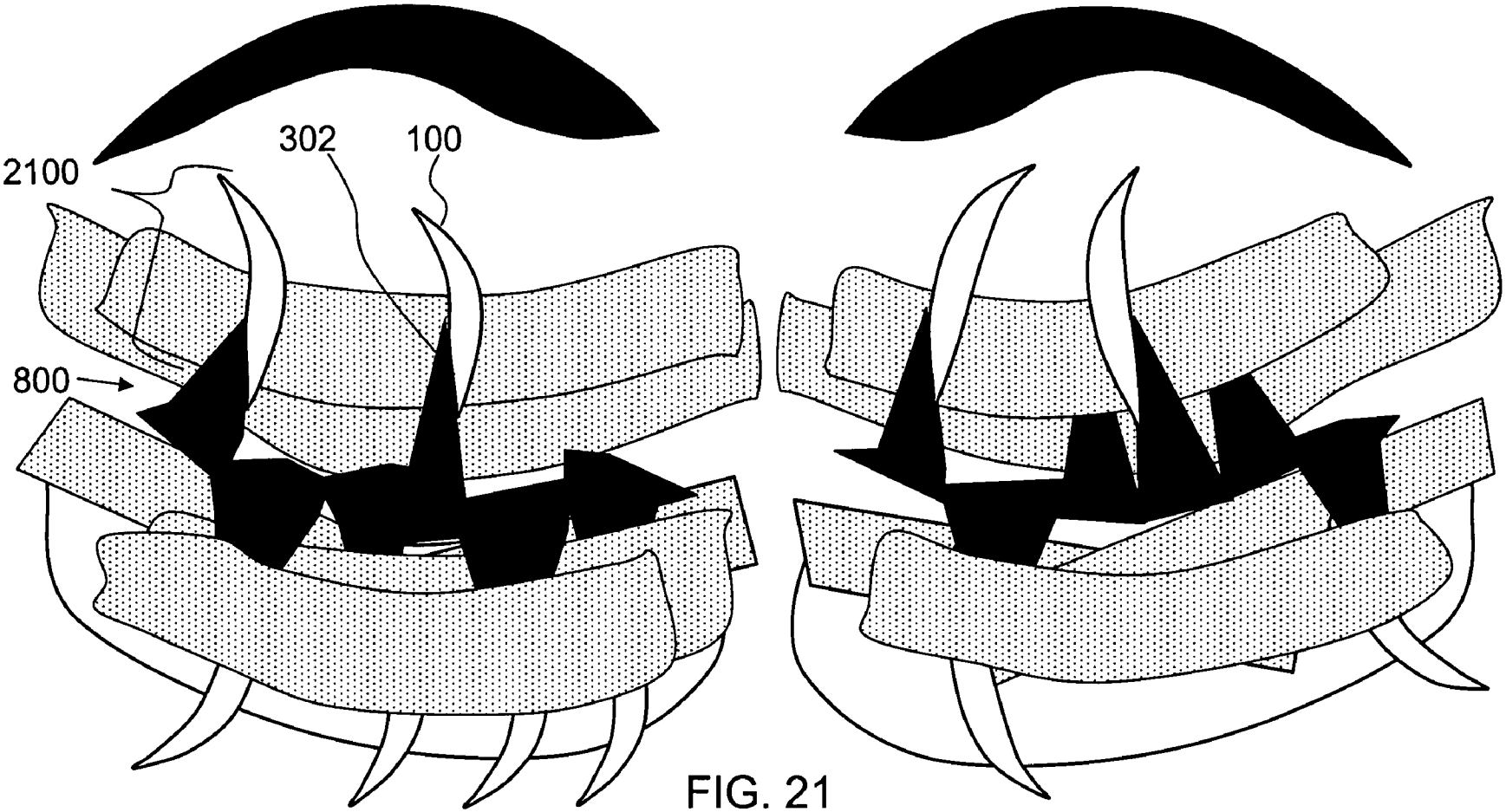
FIG. 21 is an illustration depicting eyelash extensions being affixed to the user's eyelashes.

Next, as shown in FIG. 19, a fastener 500 is used to fasten the second extended layer 1500 to the user, such as below the user's first eye 800. As shown in FIG. 20, a third layer of upper eyelashes 302 is then removed from the eyelash fastener 700. Next, as shown in FIG. 21, eyelash extensions 100 are attached with the eyelashes 302 to form a third extended eyelash layer 2100 for the user's first eye 800.

Figure 22:
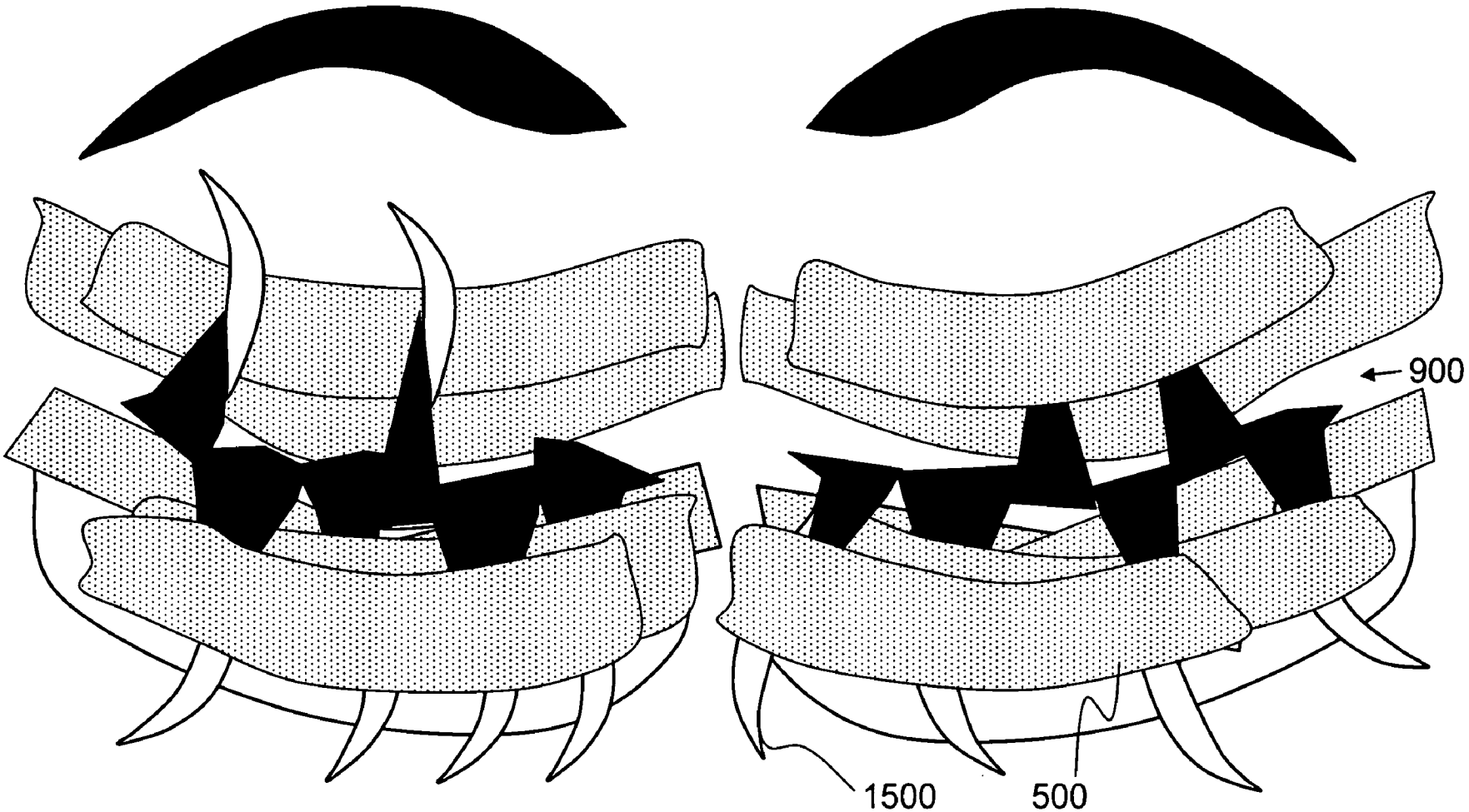
FIG. 22 is an illustration depicting the user's eyelashes with extensions being taped down.
Figure 23:
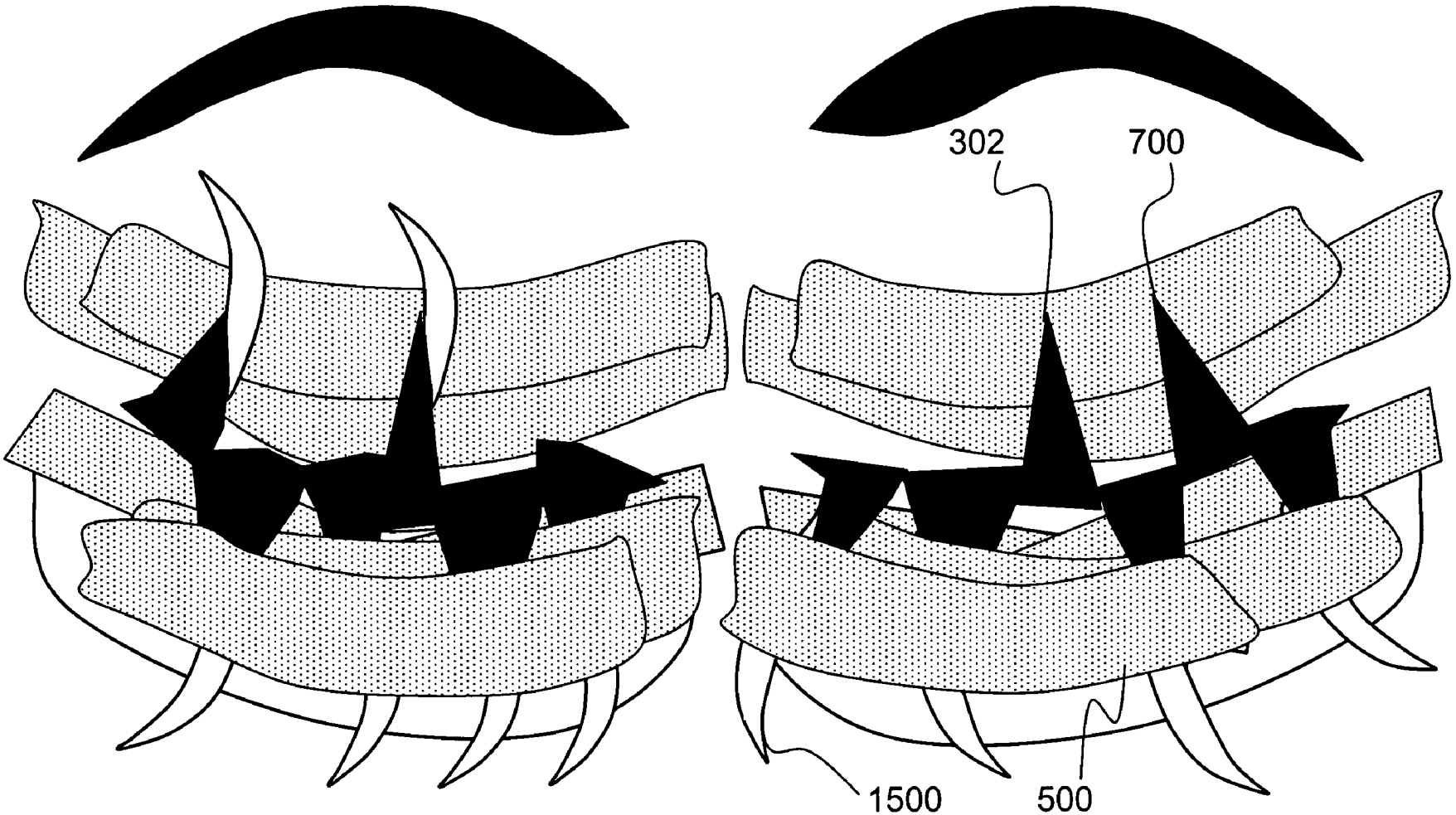
FIG. 23 is an illustration depicting the user's eyelashes being pulled from the tape.
Figure 24:
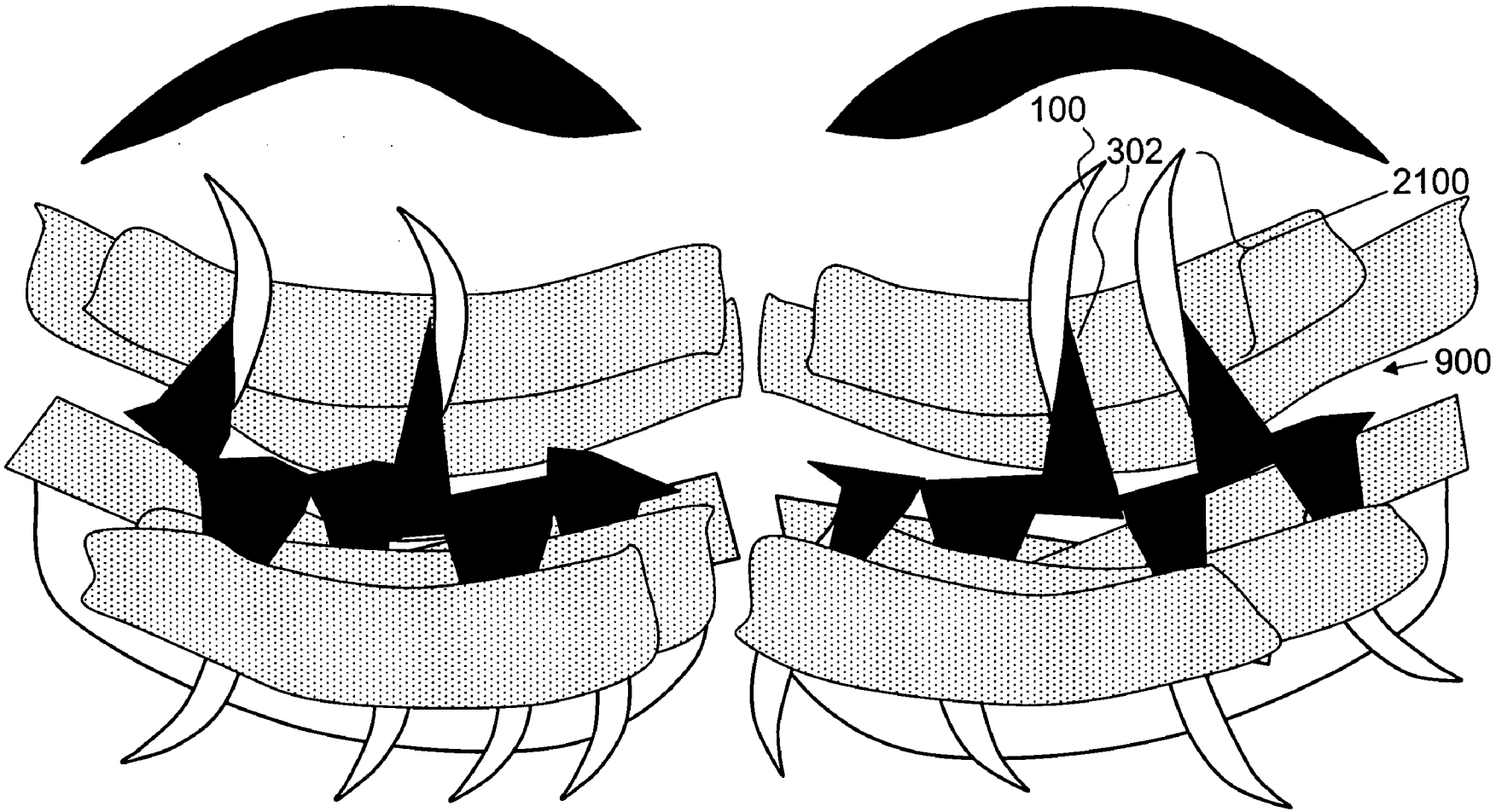
FIG. 24 is an illustration depicting eyelash extensions being affixed to the user's eyelashes.

Returning to the user's second eye 900, as shown in FIG. 22, a fastener 500 is used to fasten the second extended layer 1500 to the user, such as below the user's second eye 900. Next, as shown in FIG. 23, a third layer of upper eyelashes 302 is removed from the eyelash fastener 700. As shown in FIG. 24, eyelash extensions 100 are thereafter attached to the eyelashes 302 to form the third extended eyelash layer 210 for the user's second eye 900.

As described above, multiple layers of eyelash extensions 100 are attached to create multiple extended eyelash layers. As can be appreciated by one skilled in the art, the above process can be completed as few or as many times as the user desires layers of extended eyelashes. For example, if the user desired only two layers, then the method described above would be stopped after the application of the second extended eyelash layer 1500. Additionally, the method was described with the eyelash extensions 100 being attached alternately between the first eye 800 and the second eye 900. Alternating the application allows time for the adhesive to dry on the first eye 800 while working on the second eye 900. A dried adhesive reduces the risk that the adhesive will stick to the fastener 500 when the fastener 500 is positioned over any of the extended eyelash layers. However, as can appreciated by one skilled in the art, the method described above can be completed by creating all of the extended eyelash layers on the first eye 800 prior to working on the second eye 900 (or any combination thereof).

Additionally, the extended eyelash layers were described as being fastened below the user's eyes prior to the application of an additional extended eyelash layer. As can be appreciated by one skilled in the art, the extended eyelash layers can also be applied and fastened to the user's upper eyelid between applications (instead of below the user's eyes).

Moreover, the upper eyelashes were described above as being initially fastened to the user's upper eyelids using the eyelash fastener. In another aspect, the upper eyelashes can be initially fastened below the user's eyes. In this aspect, the upper eyelashes are pulled from the eyelash fastener below the user's eye to allow for application of the eyelash extensions. Thereafter, the upper eyelash extended layers are taped to the user's upper eyelid to enable a separation of the extended eyelash layers.

Figure 25:
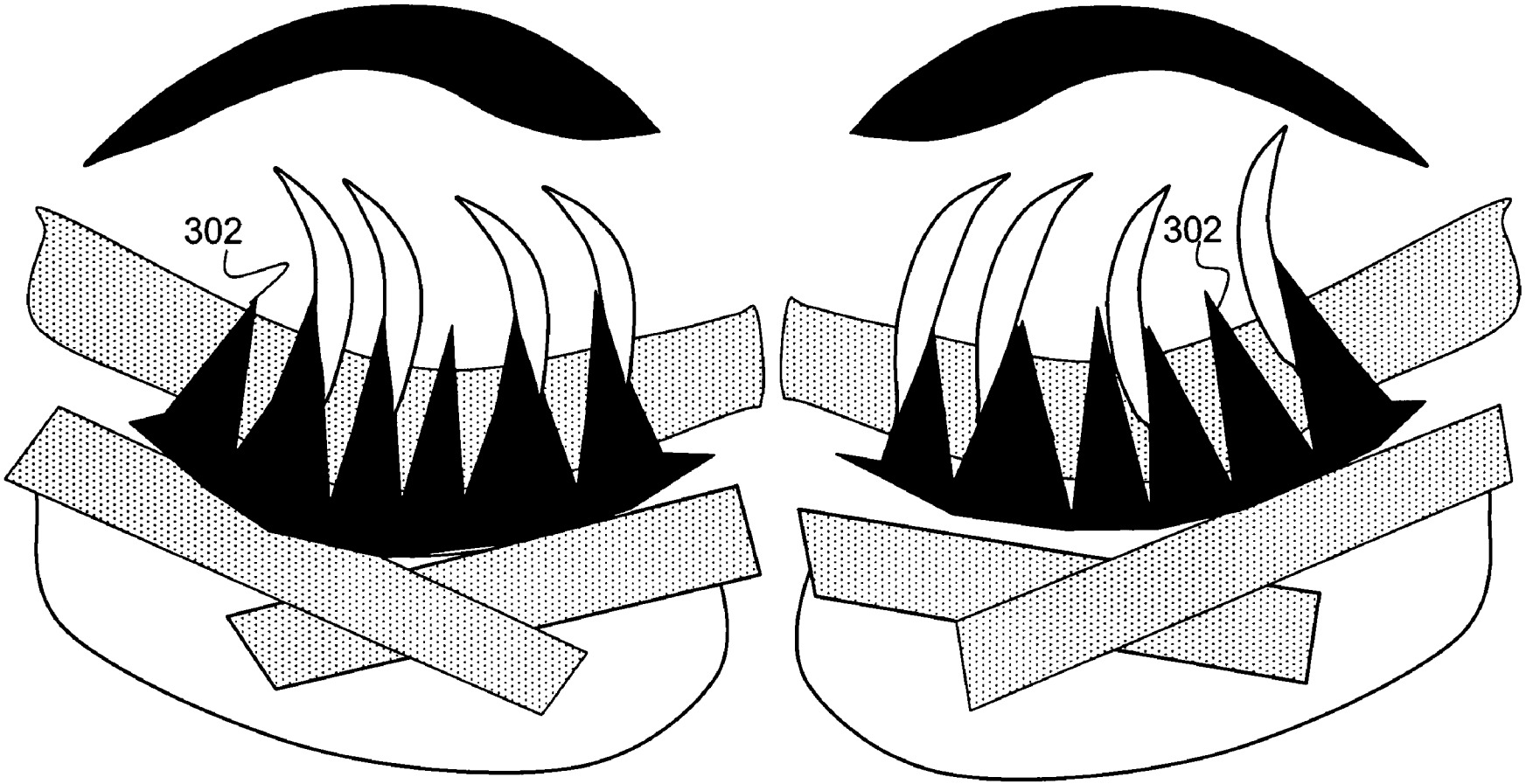
FIG. 25 is an illustration depicting the application of a last layer of eyelash extensions, where the tape is removed to expose the last layer of eyelashes.

Furthermore, the final (last) layer of eyelash extensions 100 can be applied as described above with respect to the third extended eyelash layer (or other numeric layer as the case may be). Alternatively, as shown in FIG. 25, the last layer can be applied by removing the fasteners and eyelash fastener to release the upper eyelashes 302 and extended eyelash layers.

Figure 26:
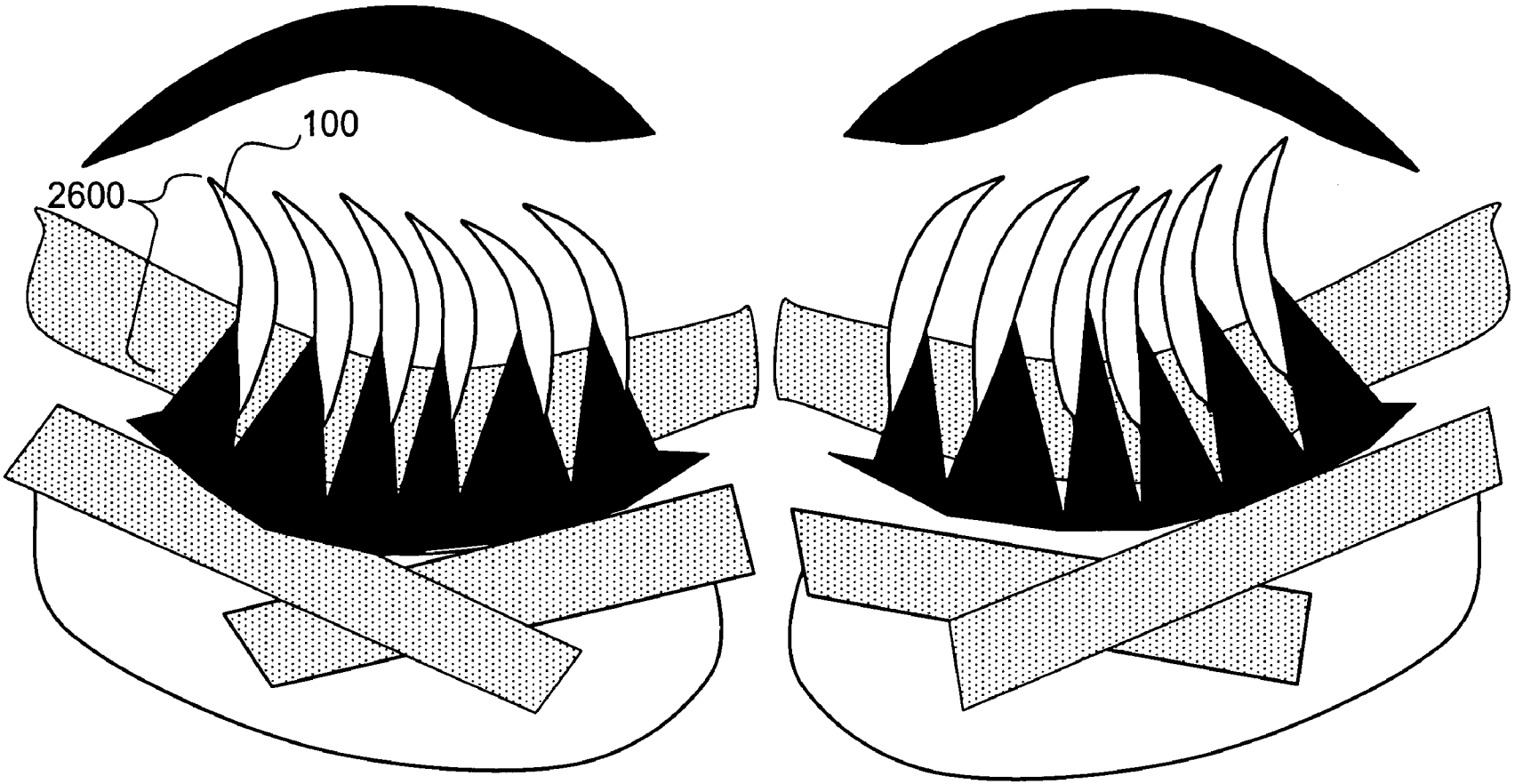
FIG. 26 is an illustration depicting the application of the last layer of eyelash extensions.

Thereafter, as shown in FIG. 26, the final layer of eyelash extensions 100 can be selectively applied to create a last extended eyelash layer 2600.

Figure 27:
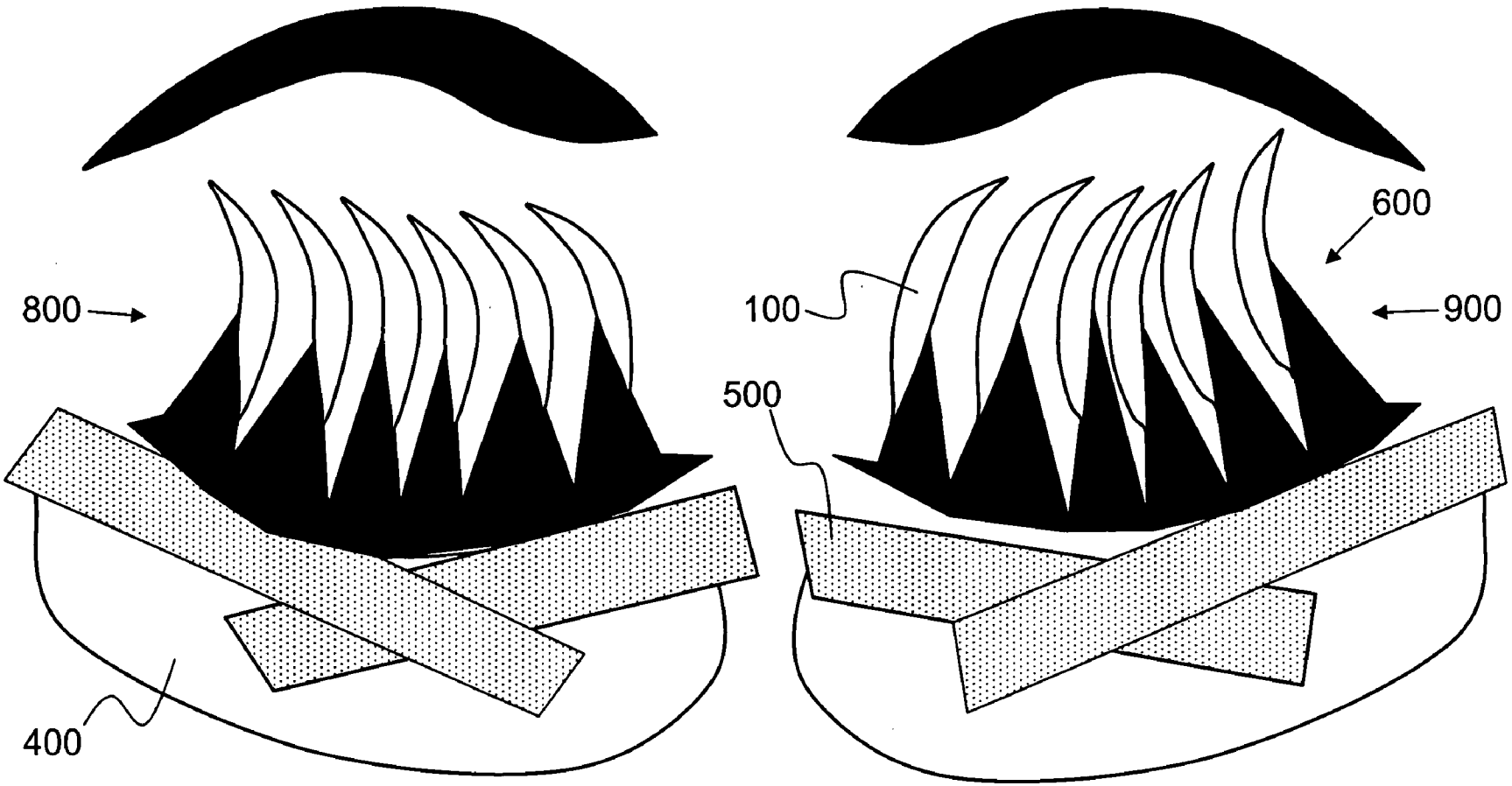
FIG. 27 is an illustration depicting the user's eyelashes with the tape removed.

As shown in FIG. 27, after all of the extended eyelash layers are applied, the fastener on the upper eyelid 600 is removed. At this point, the eyelashes can be fixed. For example, adjacently stuck eyelashes are unstuck, eyelash extensions are attached to missed eyelashes, and the eyelash extensions can be adjusted. Additionally, the user can then open their eyes to enable a comparison to ensure evenness of the eyelash extensions 100 on the first eye 800 with those of the second eye 900. At this point, eyelash extensions 100 can be removed, adjusted, or attached to ensure evenness between the two eyes 800 and 900. The remaining fasteners 500 and patches 400 can also be removed to allow the user to open their eyes without any restrictions.

After removing all of the fasteners from both eyes, the user is asked to look up, down, and around to further assure an even application of the eyelash extensions. Additionally, eyelashes at the corners of both eyes are sometimes missed. Eyelash extensions 100 can further be attached to eyelashes at the corners of the eyes to further ensure a natural look.

Figure 28:
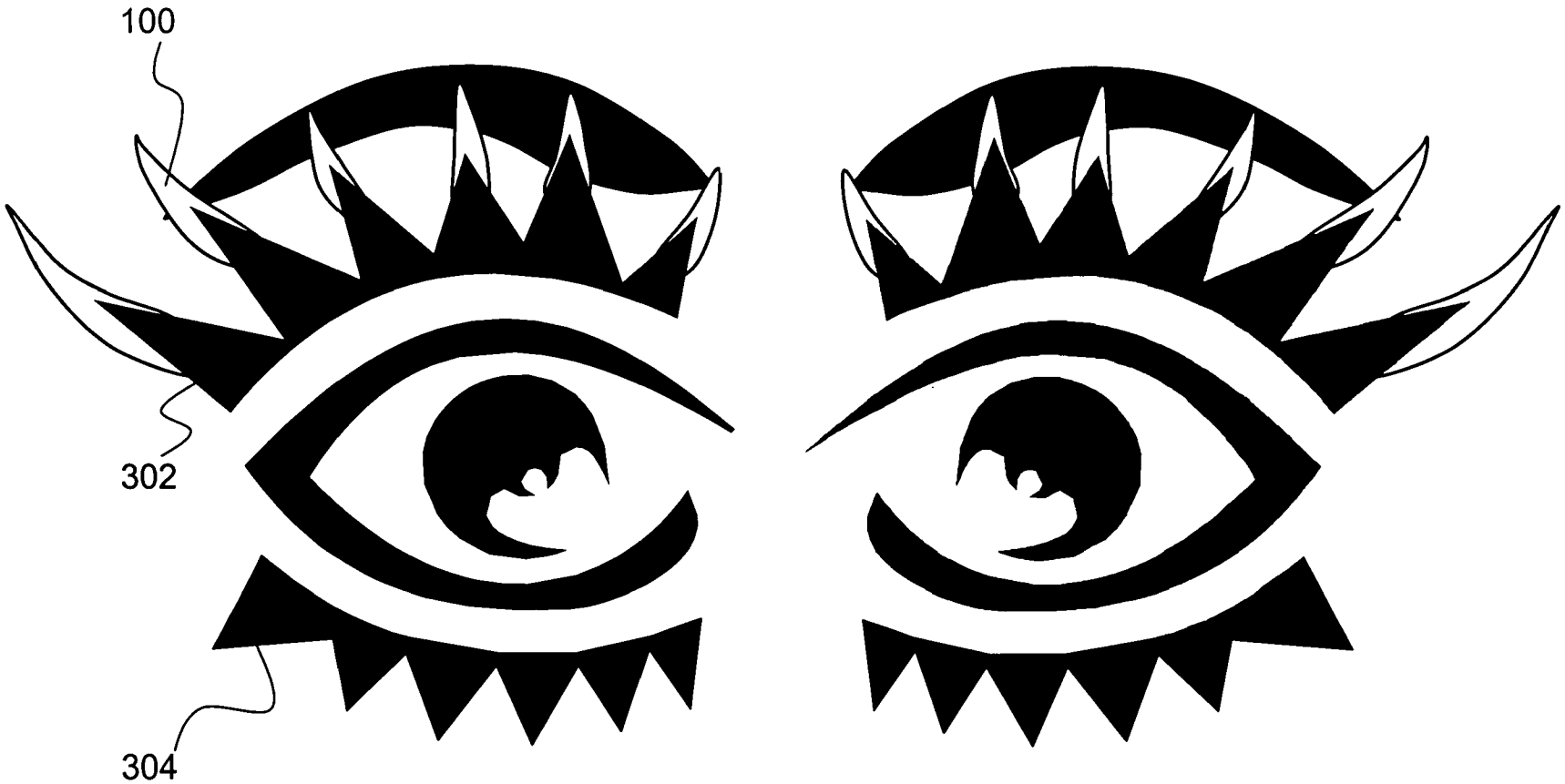
FIG. 28 is an illustration depicting the user's eyes with eyelash extensions affixed to the user's eyelashes.

FIG. 28 illustrates the result of the method of the present invention. As shown, multiple layers of eyelash extensions 100 are attached with the user's upper eyelashes to provide a natural and beautiful look. As can be appreciated by one skilled in the art, the present invention is not limited to the upper eyelashes 302 and the method described herein can also be used to attach eyelash extensions to the lower eyelashes 304.

After wearing the eyelash extensions for a period of time, it is common for the adhesive to fail and for the eyelash extensions to fall off. As the eyelash extensions fall off, it is often desirable to perform a touch-up where additional eyelash extensions are applied. The touch-up process uses the method of the present invention where extended eyelash layers are fastened to allow for the application of eyelash extensions to free eyelashes, thereby maintaining the beauty of the user.

Finally, as can be appreciated by one skilled in the art, the method described herein can be used for any form of eyelash extensions and is not limited to the extensions illustrated herein.

What is claimed is:

1. A method for applying eyelash extensions to eyelashes, comprising acts of:

fastening a user's eyelashes against a user's face using an eyelash fastener; and attaching multiple layers of eyelash extensions to the user's eyelashes, where each of the multiple layers is applied one layer at a time, thereby providing a user with eyelashes having eyelash extensions attached thereto; and wherein the user has upper eyelashes, lower eyelashes, and an upper eyelid, and wherein the act of attaching multiple layers of eyelash extensions further comprises acts of:

removing a first layer of upper eyelashes from the eyelash fastener, attaching an eyelash extension to at least one eyelash of the first layer, where a single eyelash extension is attached to a single eyelash to form a first extended eyelash layer;

fastening the first extended eyelash layer to the user using a fastener;

removing a second layer of upper eyelashes from the eyelash fastener; and attaching an eyelash extension to at least one eyelash of the second layer, where a single eyelash extension is attached to a single eyelash to from a second extended eyelash layer.

2. A method as set forth in claim 1, further comprising an act of cleaning the user's eyelashes prior to the act of fastening the user's eyelashes against the user's face.

3. A method as set forth in claim 2, further comprising an act of drying the user's eyelashes after cleaning the eyelashes.

4. A method as set forth in claim 3, wherein the user has upper eyelashes, lower eyelashes, and an upper eyelid, and wherein the act of fastening the user's eyelashes further comprises acts of:

applying a patch underneath the user's lower eyelashes;

fastening the user's lower eyelashes to the patch using a fastener;

applying a fastener to the user's upper eyelid; and fastening the user's upper eyelashes to the upper eyelid using an eyelash fastener.

5. A method as set forth in claim 4, wherein the act of attaching multiple layers of eyelash extensions further comprises acts of:

fastening the second extended eyelash layer to the user using a fastener;

removing a third layer of upper eyelashes from the eyelash fastener; and attaching an eyelash extension to at least one eyelash of the third layer, where a single eyelash extension is attached to a single eyelash to from a third extended eyelash layer.

6. A method as set forth in claim 5, further comprising an act of removing the fasteners from the eyelashes and extended eyelash layers.

7. A method as set forth in claim 6, further comprising an act of fixing the eyelashes by performing an act selected from a group consisting of un-sticking any adjacently stuck eyelashes, attaching eyelash extensions to missed eyelashes, and adjusting eyelash extensions.

8. A method as set forth in claim 7, wherein in the act of attaching multiple layers of eyelash extensions, the multiple layers are attached alternately between a first eye and a second eye, such that the first extended eyelash layer is applied to the first eye and then the second eye, with the second extended eyelash layer then being applied to the first eye and then the second eye, and with the third extended eyelash layer then being applied to the first eye then the second eye.

9. A method as set forth in claim 8, further comprising an act of comparing the eyelash extensions on the first eye with that of the second eye to ensure evenness, and if uneven, performing an act selected from a group consisting of attaching eyelash extensions, removing eyelash extensions, and adjusting eyelash extensions to correct the unevenness.

10. A method as set forth in claim 9, wherein the acts of applying a patch underneath the user's lower eyelashes and fastening the user's lower eyelashes to the patch, are performed while the user's eyes are open.

11. A method as set forth in claim 1, wherein the act of attaching multiple layers of eyelash extensions further comprises acts of:

fastening the second extended eyelash layer to the user using a fastener;

removing a third layer of upper eyelashes from the eyelash fastener; and attaching an eyelash extension to at least one eyelash of the third layer, where a single eyelash extension is attached to a single eyelash to from a third extended eyelash layer.

12. A method as set forth in claim 1, further comprising an act of removing the fasteners from the eyelashes and extended eyelash layers.

13. A method as set forth in claim 1, wherein the user has upper eyelashes, lower eyelashes, and an upper eyelid, and wherein the act of fastening the user's eyelashes further comprises acts of:

applying a patch underneath the user's lower eyelashes;

fastening the user's lower eyelashes to the patch using a fastener;

applying a fastener to the user's upper eyelid; and fastening the user's upper eyelashes to the upper eyelid using an eyelash fastener.

14. A method as set forth in claim 1, further comprising an act of fixing the eyelashes by performing an act selected from a group consisting of un-sticking any adjacently stuck eyelashes, attaching eyelash extensions to missed eyelashes, and adjusting eyelash extensions.

15. A method as set forth in claim 1, wherein in the act of attaching multiple layers of eyelash extensions, the multiple layers are attached alternately between a first eye and a second eye, such that a first extended eyelash layer is applied to the first eye and then the second eye, with a second extended eyelash layer then being applied to the first eye and then the second eye, and with a third extended eyelash layer then being applied to the first eye then the second eye.

16. A method as set forth in claim 1, further comprising an act of comparing the eyelash extensions on the first eye with that of the second eye to ensure evenness, and if uneven, performing an act selected from a group consisting of attaching eyelash extensions, removing eyelash extensions, and adjusting eyelash extensions to correct the unevenness.

17. A method for applying eyelash extensions to eyelashes, comprising acts of:

fastening a user's eyelashes against a user's face using an eyelash fastener; and attaching multiple layers of eyelash extensions to the user's eyelashes, where each of the multiple layers is applied one layer at a time, thereby providing a user with eyelashes having eyelash extensions attached thereto;

wherein the user has upper eyelashes, lower eyelashes, and an upper eyelid, and wherein the act of fastening the user's eyelashes further comprises acts of:

applying a patch underneath the user's lower eyelashes;

fastening the user's lower eyelashes to the patch using a fastener;

applying a fastener to the user's upper eyelid;

fastening the user's upper eyelashes to the upper eyelid using an eyelash fastener; and wherein the act of the act of attaching multiple layers of eyelash extensions further comprises acts of:

removing a first layer of upper eyelashes from the eyelash fastener, attaching an eyelash extension to at least one eyelash of the first layer, where a single eyelash extension is attached to a single eyelash to form a first extended eyelash layer;

fastening the first extended eyelash layer below the user's eye using a fastener;

removing a second layer of upper eyelashes from the eyelash fastener;

attaching an eyelash extension to at least one eyelash of the second layer, where a single eyelash extension is attached to a single eyelash to from a second extended eyelash layer;

fastening the second extended eyelash layer below the user's eye using a fastener;

removing a third layer of upper eyelashes from the eyelash fastener;

attaching an eyelash extension to at least one eyelash of the third layer, where a single eyelash extension is attached to a single eyelash to from a third extended eyelash layer; and further comprising an act of removing the fasteners from the eyelashes and extended eyelash layers, thereby providing the user with eyelashes having eyelash extensions fastened thereto.

* * * * *